US008931875B2

(12) United States Patent
Kosaka et al.

(10) Patent No.: US 8,931,875 B2
(45) Date of Patent: Jan. 13, 2015

(54) INKJET PRINTING APPARATUS AND INKJET PRINTING METHOD

(75) Inventors: Kei Kosaka, Tokyo (JP); Minoru Teshigawara, Saitama (JP); Atsushi Sakamoto, Yokohama (JP); Takeshi Murase, Yokohama (JP); Yoshiyuki Honda, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 85 days.

(21) Appl. No.: 13/618,467

(22) Filed: Sep. 14, 2012

(65) Prior Publication Data

US 2013/0093809 A1 Apr. 18, 2013

(30) Foreign Application Priority Data

Oct. 12, 2011 (JP) ..... 2011-224816
Jul. 20, 2012 (JP) ..... 2012-161416

(51) Int. Cl.
*B41J 2/05* (2006.01)

(52) U.S. Cl.
USPC ..... 347/17; 347/5; 347/9

(58) Field of Classification Search
USPC ..... 347/5, 9, 14, 15, 17
IPC ..... B41J 2/0454
See application file for complete search history.

(56) References Cited

U.S. PATENT DOCUMENTS 5,861,895 A 1/1999 Tajika et al.
6,068,363 A * 5/2000 Saito ..... 347/17
6,224,182 B1 5/2001 Nagoshi et al.
6,322,189 B1 * 11/2001 Anderson et al. ..... 347/17
6,641,243 B2 * 11/2003 Anderson et al. ..... 347/17
7,431,415 B2 * 10/2008 Hetzer et al. ..... 347/17
7,758,153 B2 7/2010 Tanaka et al.
7,782,350 B2 8/2010 Tanaka et al.
2012/0194587 A1 8/2012 Teshigawara et al.

FOREIGN PATENT DOCUMENTS

JP 05-031905 A 2/1993
JP 06-336022 A 12/1994
JP 10-100409 A 4/1998
JP 2000-334958 A 12/2000
JP 06-336022 A5 1/2001

* cited by examiner

*Primary Examiner* — Lam S Nguyen
(74) *Attorney, Agent, or Firm* — Fitzpatrick, Cella, Harper & Scinto

(57) ABSTRACT

There is provided an inkjet printing apparatus which can output a stable image without density unevenness by performing appropriate drive control to print elements based upon an appropriate representative temperature of a chip whatever image data is printed on a print medium. For this purpose, detection temperatures of a plurality of temperature sensors are lined up in high temperature order, and coefficients by which the respective detection temperatures are multiplied, are determined to be associated with that order at the lining-up, determining a representative temperature by the weighted average method. The common drive pulse associated with to the individual chip based upon the representative temperature thus obtained, to be applied thereto. Thereby even if temperature variations of print elements on the chip exist, it is possible to appropriately control the entire chip in temperature.

26 Claims, 20 Drawing Sheets

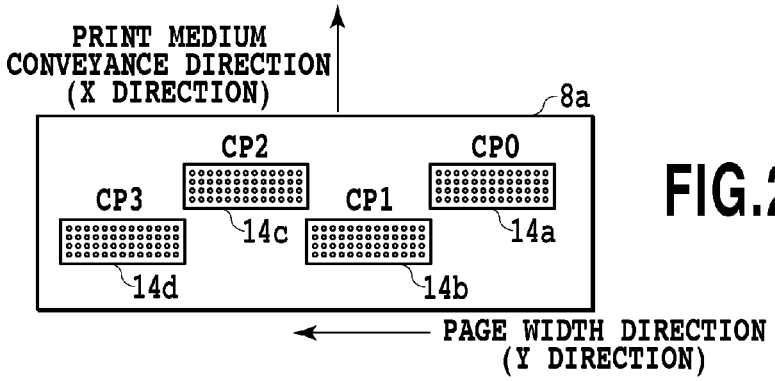
FIG.2A
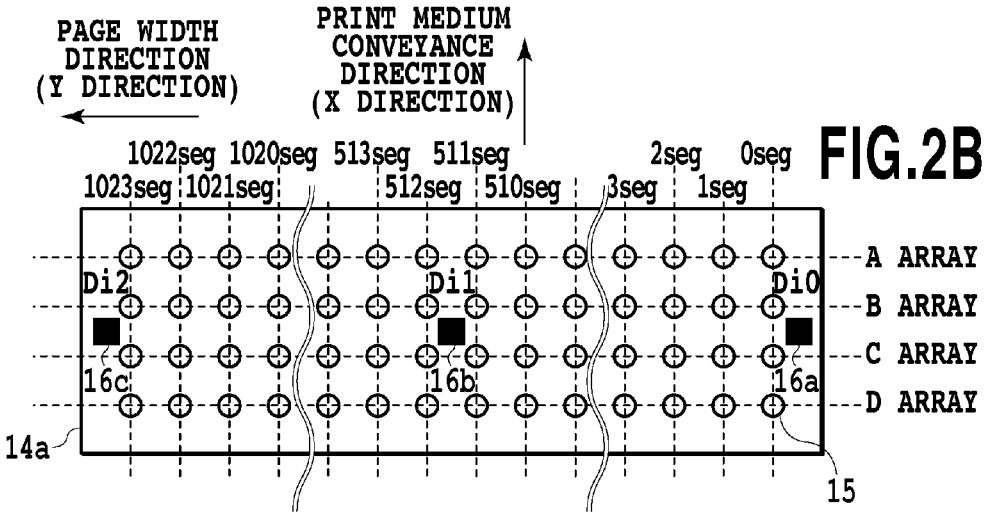
FIG.2B
FIG.2C
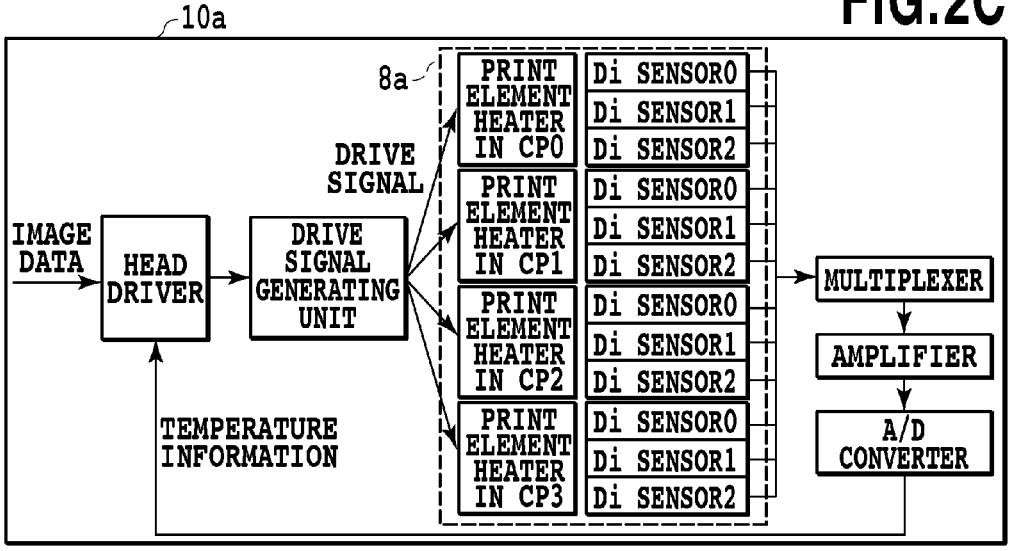

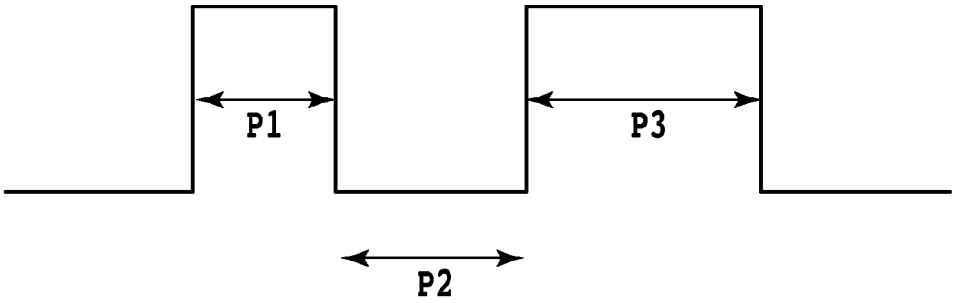
FIG.3A
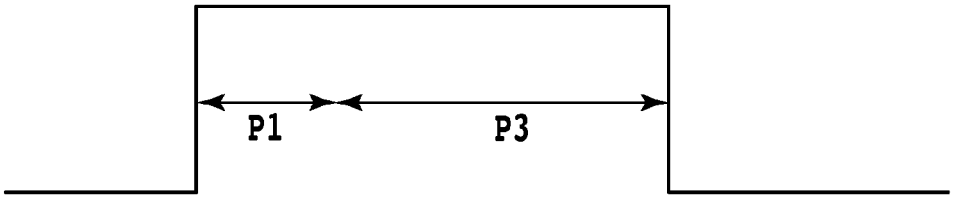
FIG.3B
| CHIP TEMPERATURE [℃] | P1[μsec] | P2[μsec] | P3[μsec] | PWM No. |
|---|---|---|---|---|
| ~30 | 0.95 | 3.50 | 2.65 | 14 |
| ~31 | 0.95 | 3.25 | 2.63 | 13 |
| ~32 | 0.95 | 3.00 | 2.60 | 12 |
| ~33 | 0.95 | 2.75 | 2.58 | 11 |
| ~34 | 0.95 | 2.50 | 2.55 | 10 |
| ~35 | 0.95 | 2.25 | 2.53 | 9 |
| ~36 | 0.95 | 2.00 | 2.50 | 8 |
| ~37 | 0.95 | 1.75 | 2.48 | 7 |
| ~38 | 0.95 | 1.50 | 2.45 | 6 |
| ~39 | 0.95 | 1.25 | 2.40 | 5 |
| ~40 | 0.95 | 1.00 | 2.35 | 4 |
| ~41 | 0.95 | 0.80 | 2.33 | 3 |
| ~42 | 0.95 | 0.58 | 2.30 | 2 |
| 42~ | 0.95 | 0.00 | 2.25 | 1 |
FIG.3C

DENSITY UNEVENNESS EVALUATION RESULT

| | PATTERN A | PATTERN B |
|---|---|---|
| FIXED WEIGHTED AVERAGE | △ | ○ |
| MAXIMUM VALUE CONTROL | ○ | △ |
| DYNAMIC WEIGHTED AVERAGE | ○ | ○ |

FIG.10

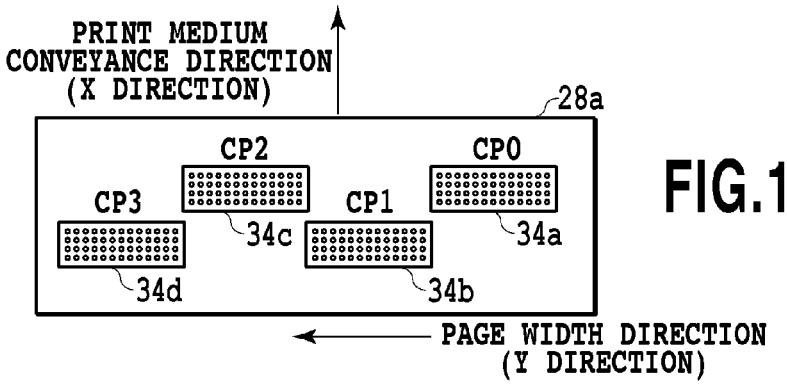
FIG.12A
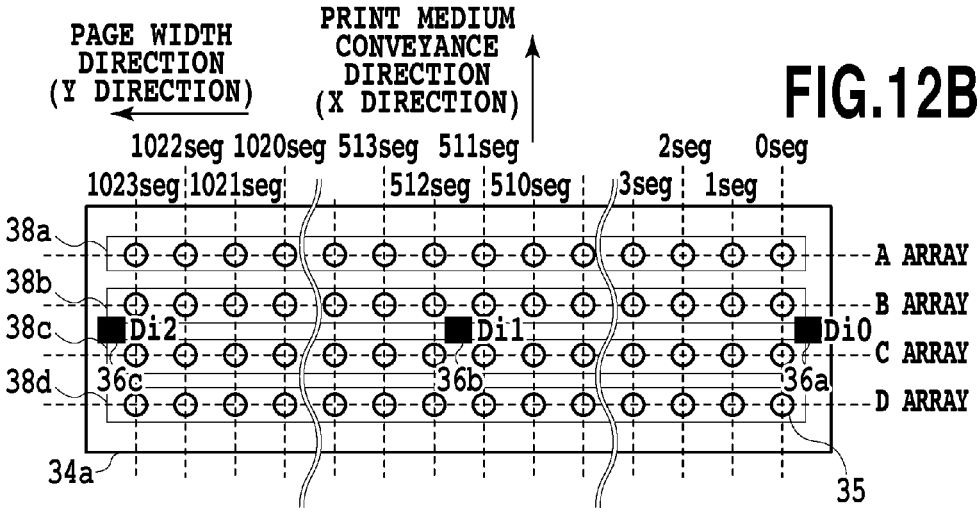
FIG.12B
FIG.12C
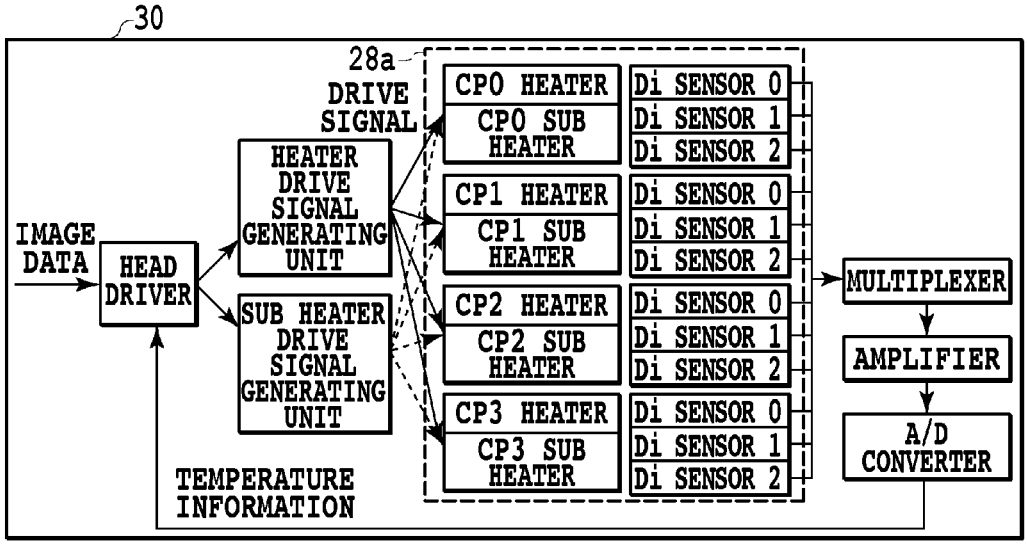

| CHIP TEMPERATURE[℃] | P4[μsec] |
|---|---|
| ~30 | 1050 |
| ~31 | 1000 |
| ~32 | 950 |
| ~33 | 900 |
| ~34 | 850 |
| ~35 | 800 |
| ~36 | 750 |
| ~37 | 700 |
| ~38 | 650 |
| ~39 | 600 |
| ~40 | 550 |
| ~41 | 500 |
| ~42 | 450 |
| ~43 | 400 |
| ~44 | 350 |
| ~45 | 300 |
| ~46 | 250 |
| ~47 | 200 |
| ~48 | 150 |
| ~49 | 100 |
| ~50 | 50 |
| 50~ | 0 |

DENSITY UNEVENNESS EVALUATION RESULT

| | PATTERN C | PATTERN D |
|---|---|---|
| FIXED WEIGHTED AVERAGE | ○ | △ |
| MAXIMUM VALUE CONTROL | △ | ○ |
| DYNAMIC WEIGHTED AVERAGE | ○ | ○ |

FIG.19

INKJET PRINTING APPARATUS AND INKJET PRINTING METHOD

BACKGROUND OF THE INVENTION

1. Field of the Invention

The present invention relates to an inkjet printing apparatus for printing an image by using thermal energy and an inkjet printing method thereof. In particular, the present invention relates to a control method of a print head in an inkjet printing apparatus for alleviating an image defect caused by a temperature distribution within the print head.

2. Description of the Related Art

In the inkjet printing apparatus, thermal energy is provided to a plurality of print elements arranged in the print head according to image data to eject ink from the individual print elements, thus printing an image on a print medium. In such an inkjet printing apparatus, an ink temperature in the print element is influenced by ejection frequency of the print element or print elements in the surroundings thereof, and as the ink temperature is higher, an ejection amount of the ink also becomes the larger. Therefore there are some cases where even within the same print head, the ejection amount varies depending on irregularities of the ejection frequency or the ejection amount changes in accordance with an elapse time from a print start, inviting the density unevenness in the image on the print medium.

For example, Japanese Patent Laid-Open No. H05-031905 (1993) discloses an ejection amount control method (PWM control) for solving this problem. According to the PWM control, there is disclosed the method in which a pulse width of a voltage pulse applied to each of the print elements is adjusted in accordance with a temperature of a chip in which a plurality of print elements are arranged, and even if a temperature change occurs in the chip, the ejection amount can be kept constant. In addition, Japanese Patent Laid-Open No. H06-336022(1994) discloses the method in which a sub heater, which heats a print head to a temperature at which a stable ejection is ensured, is controlled in response to a detection temperature of a temperature sensor arranged near the print element.

According to Japanese Patent Laid-Open No. H05-031905 (1993) or Japanese Patent Laid-Open No. H06-336022 (1994), it is required for a temperature distribution of the plurality of the print elements to be detected as accurately as possible. As the detection error is large as compared to an actual temperature distribution, the ejection amount control can not be normally performed, so that the density unevenness can not be alleviated or the density unevenness is rather worsened. Therefore in recent years, there is provided an inkjet printing apparatus in which, with the aim of accuracy improvement on the temperature detection, a plurality of temperature sensors are arranged on a single chip to determine the detection temperatures in a comprehensive manner, thus performing the drive control to print elements at ejection. For example, Japanese Patent Laid-Open No. 2000-334958 discloses the method for performing PWM control based upon an average value of a plurality of detection temperatures obtained from a plurality of temperature sensors. In addition, Japanese Patent Laid-Open No. H10-100409(1998) discloses the method for weighting each of the detection temperatures corresponding to a position of the temperature sensor on a chip to determine a representative temperature for the drive control.

However, in some cases the method for finding the representative temperature for the drive control according to Japanese Patent Laid-Open No. 2000-334958 or Japanese Patent Laid-Open No. H10-100409(1998) does not work appropriately in a case of a full line type of inkjet printing apparatus.

The full line type of inkjet printing apparatus uses a print head in which a plurality of chips are arranged to the extent corresponding to a width of the print medium, each chip having a plurality of print elements arranged thereon. Ink is ejected on the print medium moving in a direction crossing the arrangement direction of the print elements from each print element, thus printing an image on the print medium. In such a full line type of inkjet printing apparatus, printing can be performed on print media having various sizes as long as the image is equal to or less than the arrangement width of the chips, but in this case, only the limited chips or the print elements in the limited region are used for printing, and a temperature gradient within the print head becomes large. Also in this situation, the temperature detection method disclosed in Japanese Patent Laid-Open No. 2000-334958 or Japanese Patent Laid-Open No. H10-100409(1998) can be adopted, but since a detection temperature in a region not used in printing is also used for determining the representative temperature, there occurs a possibility that the temperature in the region used in printing can not be accurately detected. That is, in the full line type of inkjet printing apparatus, even if the method disclosed in Japanese Patent Laid-Open No. 2000-334958 or Japanese Patent Laid-Open No. H10-100409 (1998) is adopted, there occurs concern that the density unevenness may not be reduced or may be rather worsened depending upon image data.

SUMMARY OF THE INVENTION

Therefore the present invention is made in view of the foregoing problems, and an object of the present invention is to output a stable image without density unevenness by performing appropriate drive control to print elements based upon an appropriate representative temperature of a chip whatever image data is printed on a print medium.

In a first aspect of the present invention, there is provided an inkjet printing apparatus comprising: a print head having a substrate provided with an element array in which a plurality of print elements for ejecting ink by applying drive pulses thereto are arranged and a plurality of temperature sensors for temperature measurement; an obtaining unit configured to find respective temperatures of the plurality of the temperature sensors to obtain a plurality of detection temperatures; a determining unit configured to line up the plurality of the detection temperatures in temperature order to determine coefficients by which the respective detection temperatures are multiplied, to be associated with that order at the lining-up; and a calculating unit configured to multiply each of the plurality of the detection temperatures by the coefficient determined by the determining unit for weighted average to calculate a representative temperature.

In a second aspect of the present invention, there is provided a n inkjet printing method for an inkjet printing apparatus using a print head for printing, that has a substrate provided with an element array in which a plurality of print elements for ejecting ink by applying drive pulses thereto are arranged and a plurality of temperature sensors for temperature measurement, comprising: an obtaining step for finding respective temperatures of the plurality of the temperature sensors to obtain a plurality of detection temperatures; a determining step for lining up the plurality of the detection temperatures in temperature order to determine coefficients by which the respective detection temperatures are multiplied, to be associate with that order at the lining-up; a calculating step for multiplying each of the plurality of the detection temperatures by the coefficient determined by the determining step for weighted average to calculate a representative temperature; and a drive control step for controlling the drive pulse based upon the representative temperature calculated in the calculating step to be applied to the plurality of the print elements.

Further features of the present invention will become apparent from the following description of exemplary embodiments (with reference to the attached drawings).

BRIEF DESCRIPTION OF THE DRAWINGS

FIGS. 2A to 2C are diagrams showing an arrangement state of ejection openings and the control configuration of a head drive component;

FIGS. 3A to 3C are diagrams explaining PWM control according to the first embodiment;

FIG. 10 is a table summarizing the results explained with reference to FIGS. 7 to 9;

FIGS. 12A to 12C are diagrams showing an arrangement state of ejection openings and the control configuration of a head drive component;

FIG. 19 is a table summarizing the results explained with reference to FIGS. 16 to 18.

DESCRIPTION OF THE EMBODIMENTS

Hereinafter, preferred embodiments according to the present invention will be explained with reference to the accompanying drawings.

First Embodiment

Figure 1A:
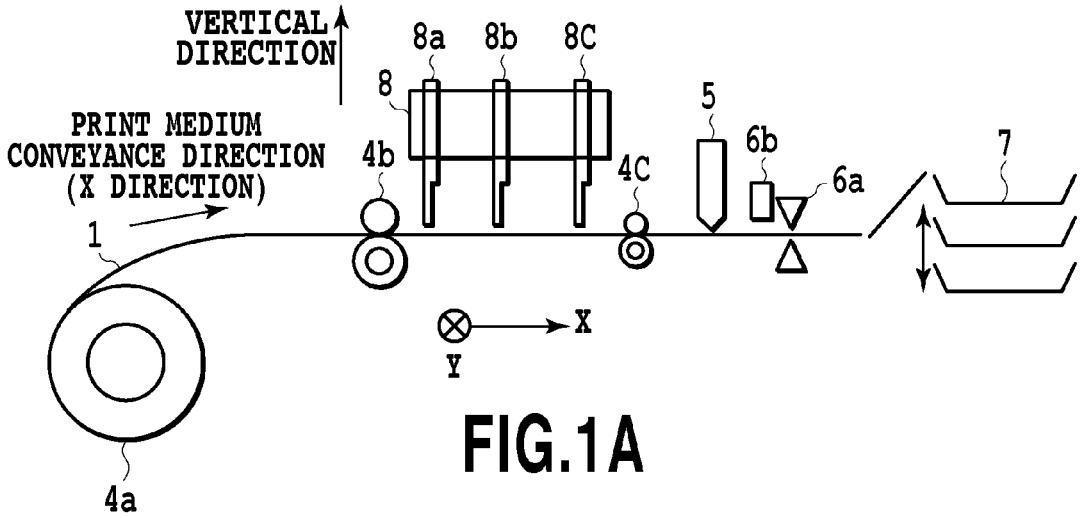
FIG. 1A and FIG. 1B are diagrams showing a printing component and the control configuration according to a first embodiment.
Figure 1B:
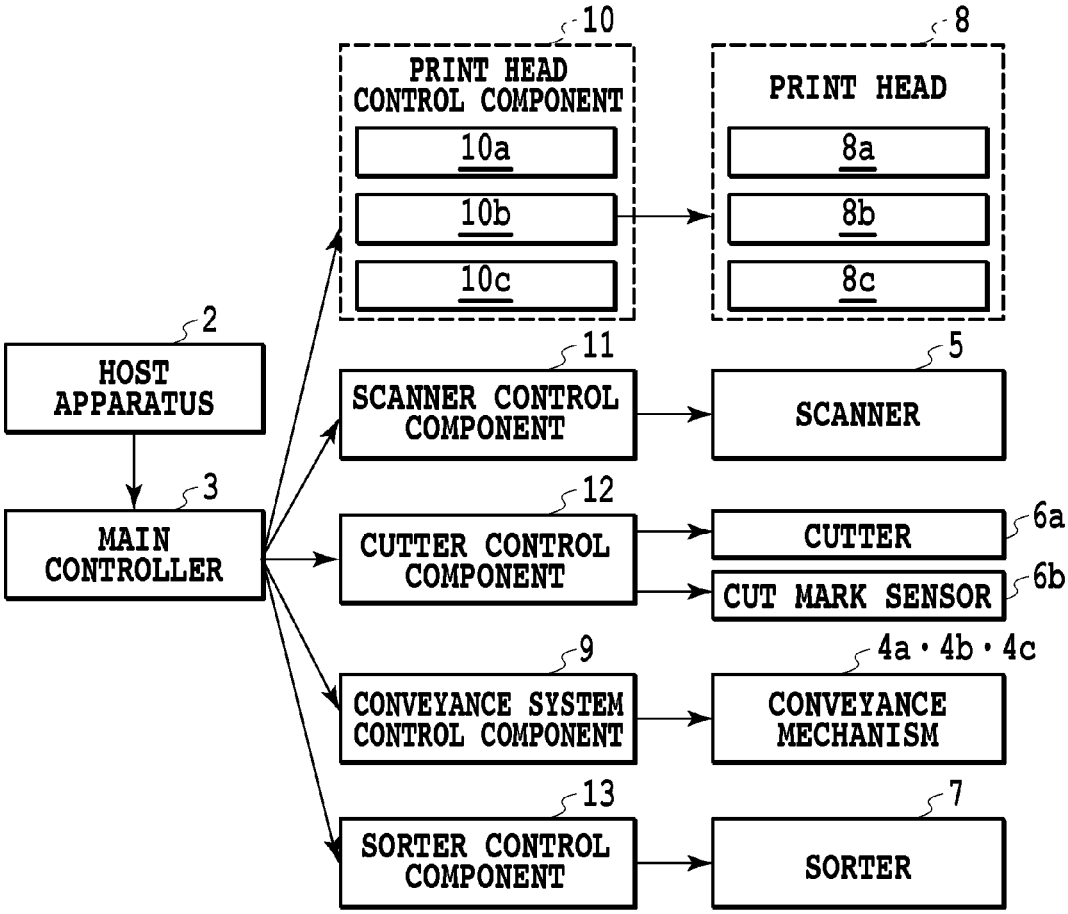

FIG. 1A and FIG. 1B are diagrams showing the configuration of a printing component and the control configuration in an inkjet printing apparatus according to the present embodiment.

By referring to FIG. 1A, a print medium 1 wound around a roll paper cassette 4*a* is conveyed in an X direction at a constant conveyance speed with rotation of the roll paper cassette 4*a*. Printing is performed by print heads 8 in a region of the print medium 1 smoothly held by paired upstream conveyance rollers 4*b* and paired downstream conveyance rollers 4*c*. The print heads 8 are provided with a cyan head 8*a* for ejecting cyan ink, a magenta head 8*b* for ejecting magenta ink, and a yellow head 8*c* for ejecting yellow ink, wherein these three heads are arranged in that order in the X direction. Each of the print heads 8*a* to 8*c* includes a plurality of print elements arranged in a pitch in accordance with a print resolution in the depth direction in the figure (Y direction).

An image printed on the print medium 1 is read in by a scanner 5 as needed. The print head 8 also prints a cut mark indicating a terminal section of the image, and a cutter 6*a* cuts the print medium 1 based upon detection timing of a cut mark sensor 6*b*. The cut print medium 1 is loaded on a tray of a sorter 7 corresponding to the size.

Next, by referring to FIG. 1B, the inkjet printing apparatus in the present embodiment is configured in such a manner as to print image data received through an interface from a host apparatus 2, subjected to control of a main controller 3. The main controller 3 controls a conveyance control component 9, a print head control component 10, a scanner control component 11, a cutter control component 12, and a sorter control component 13 for printing the received image data.

The conveyance control component 9 performs rotational drive of the roll paper cassette 4*a*, the paired upstream conveyance rollers 4*b* and the paired downstream conveyance rollers 4*c* subjected to control of the main controller 3.

The print head control component 10 includes drive components 10*a* to 10*c* corresponding to the print heads 8*a* to 8*c* respectively to eject ink from the individual print element of the print head in a predetermined timing based upon the print data received from the main controller 3. The individual print element is provided with an ink passage guiding the ink to the ejection opening, and an electro-thermal conversion element provided in the ink passage. By applying a voltage pulse to the electro-thermal conversion element corresponding to the print data, the film boiling by thermal energy is caused in the ink in the ink passage to eject the ink from the ejection opening due to growth of the generated air bubbles.

The scanner control component 11 reads an image on the print medium using the scanner 5, subjected to the control of the main controller 3 and sends the read image to the main controller 3. The cutter control component 12 performs cut mark detection of the cut mark sensor 6*b* and a cutting operation of the cutter 6*a* following it, subjected to the control of the main controller 3. The sorter control component 13 operates the sorter 7 based upon a size of the print medium 1 or a kind of the image and conveys the cut print medium to an appropriate tray, subjected to the control of the main controller 3.

FIG. 2A to FIG. 2C are diagrams respectively showing the cyan head 8*a*, an arrangement state of ejection openings in a chip 14*a*, and the control configuration in the print head drive component 10*a*. Here, the cyan head 8*a* will be explained as an example, but a magenta head 8*b* and a yellow head 8*c* respectively also have the configuration similar to that of the cyan head 8*a*.

In the print head 8*a*, as shown in FIG. 2A, four chips 14*a*-14*d* of CP0, CP1, CP2, and CP3 are arranged sequentially in the Y direction to be alternately shifted by a predetermined interval in the X direction. In the individual chip, as shown in FIG. 2B, four print element arrays (A array to D array) are arranged in parallel to each other by a predetermined interval in the X direction. In the individual print element array, 1024 pieces of print elements 15 are arranged in a pitch of 1200 dpi in the Y direction. With this configuration, the printing apparatus in the present embodiment can print an image on the print medium having a width in accordance with a distance in which the print elements are arranged sequentially in the Y direction.

In chip CP0 (14*a*), three diode sensors 16 (Di0, Di1, and Di2) (hereinafter, called Di sensors) as temperature sensors are arranged as shown in the figure. Di0 and Di2 detect temperatures at the right and left end sections in the chip in the Y direction, and Di1 detects a temperature at the center in the chip.

By referring to FIG. 2C, in the drive component 10*a*, binary image data input to a head driver is converted into drive signals corresponding to the respective print elements by a heater drive signal generating unit, which are distributed to chip CP0 to chip CP3. Since wiring to each print element is in common in the chip, the print elements in the same chip are driven by drive pulses each having the same form. On the other hand, analogue signals from a plurality of Di sensors are sequentially obtained in response to the switching of a multiplexer, and are amplified by an amplifier. Thereafter, the analogue signal is converted into a digital signal by an A/D converter. The digital signal is input to the head driver as temperature information. The head driver changes a drive pulse width for each chip based upon the obtained temperature information to match an ejection amount of each chip to a target value (PWM Control).

FIG. 3A to FIG. 3C are diagrams explaining PWM control in the present embodiment. In the inkjet printing apparatus according to the present embodiment, upon ejecting a single drop of ink from a single print element, drive pulses as shown in FIG. 3A are applied to the electro-thermal conversion element in the print element. In the figure, a lateral axis shows time and a vertical axis shows voltages, wherein P1 indicates a pre-heat pulse, P2 indicates an interval, and P3 indicates a main heat pulse. The pre-heat pulse P1 is a pulse for heating ink near the elector-thermal converter element to an appropriate temperature, and is suppressed to energy (pulse width) corresponding to the extent that the ejection operation is not performed. The main heat pulse P3 is a pulse for causing the ejection operation to be actually performed. The interval P2 shows a non-application time from an end of the pre-heat pulse P1 to a start of the main heat pulse P3. The drive method of thus applying two times of pulses for performing one time of ejection is called double-pulse drive.

Incidentally as explained before, the amount of ink ejected from the print element depends on an ink temperature in the ink passage. That is, even if a pulse width of the main heat pulse P3 is constant, the amount of the ink drops ejected changes in accordance with an ink temperature at each time. The energy amount or the width of P3 required for performing sufficient ejection also changes with an environment temperature or a head temperature. The PWM control is the method for controlling the ejection amount by using this temperature dependency. In the PWM control according to the present embodiment, P3 directly involved in the ejection operation is made to change with the detected temperature to stabilize the ejection amount. Specifically in a case where the detection temperature is low, the width of the main heat pulse P3 is made large for increasing the energy to be applied, and in a case where the detection temperature is high, the width of the main heat pulse P3 is made small for suppressing the energy to be applied.

FIG. 3C is a table showing P1, P2, and P3 set in accordance with the detected chip temperature in the present embodiment. Here, as the detection temperature increases, P3 decrease in width. In a region where the detection temperature is 42° C. or more, P2 becomes zero in width and the drive pulse is in the form of a single pulse as shown in FIG. 3B. It should be noted that the pulse forms (P1, P2, and P3) prepared corresponding to detected temperatures will be hereinafter distinguished by PWM numbers shown in the right end of the figure. The PWM table in which the detection temperature and the pulse form correspond to each other on a one-to-one basis is in advance stored in a memory in the print head control component 10.

As already explained, since the wiring to each print element is formed in common in the present embodiment, the print elements in the same chip are driven by the drive pulses each having the same form. Therefore, even if three Di sensors are arranged in a single chip, the temperature to be referred to in the PWM control is a single representative temperature, and all the print elements on the same chip are driven by any one of the PWM numbers shown in FIG. 3C set by the representative temperature. On the other hand, even in the same print head (8*a*), different chips (14*a*, 14*b*, 14*c* and 14*d*) can be driven by drive pulses of PWM numbers different with each other.

Figure 4:
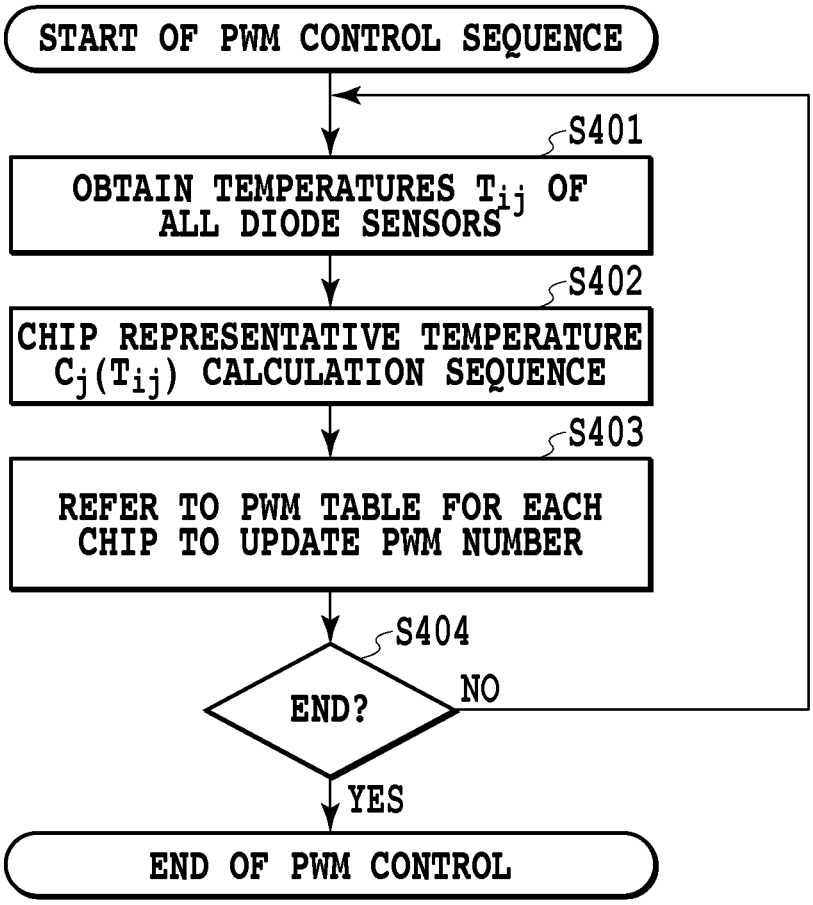
FIG. 4 is a flow chart explaining the process for updating the PWM number of an individual chip.

FIG. 4 is a flow chart explaining the process for updating the PWM number of the individual chip while the head driver performs printing. When the present process starts simultaneously with a start of the printing operation, first at step S401 the head driver obtains detection temperatures Tij of all the Di sensors on all the chips. Here, an index i is a variable for distinguish the three Di sensors on the same chip, and is an integral number of 0 to 2. In addition, an index j is a variable for distinguish the four chips on the same head, and is an integral number of 0 to 3.

At subsequent step S402 a representative temperature Cj is calculated for each chip. The representative temperature Cj is expressed as a function of the detection temperatures T0*j*, T1*j* and T2*j* in the three Di sensors and can be expressed by "Cj=Cj (Tij). A specific calculation content of the function Cj (Tij)) will be described later.

At step S403, by referring to the PWM table shown in FIG. 3C, the PWM number of each chip is updated based upon the representative temperature Cj found at step S402. At subsequent step S404, it is determined whether or not printing to the image data input by the job of this time is completed. In a case where it is determined that the image data to be printed is still left, the process goes back to step S401, and in a case where it is determined that the printing of all the image data is completed, the present process terminates. It should be noted that in the process from step S401 to step S404, the process may be repeatedly executed by any interval having time or image data as a unit such that the drive pulse is updated at timing to the extent that the density unevenness is not distinct.

Figure 5A:
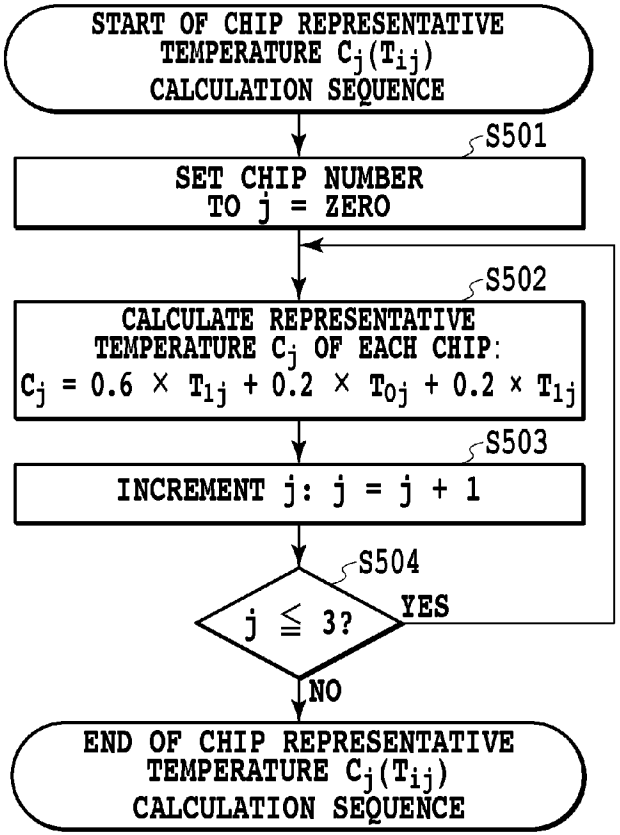
FIGS. 5A to 5C are flow charts each explaining a calculation method of a representative temperature in a chip.
Figure 5B:
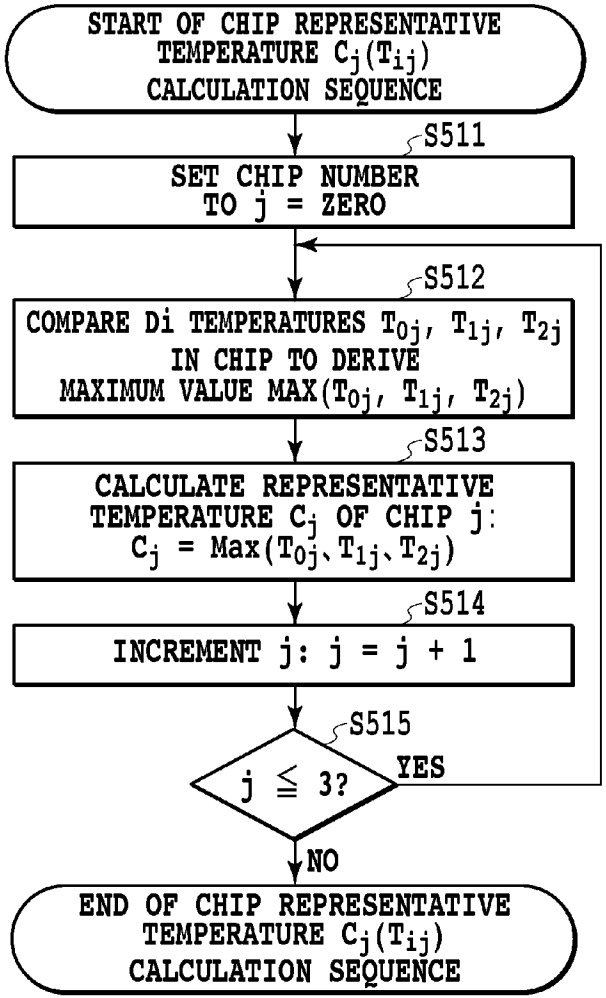
Figure 5C:
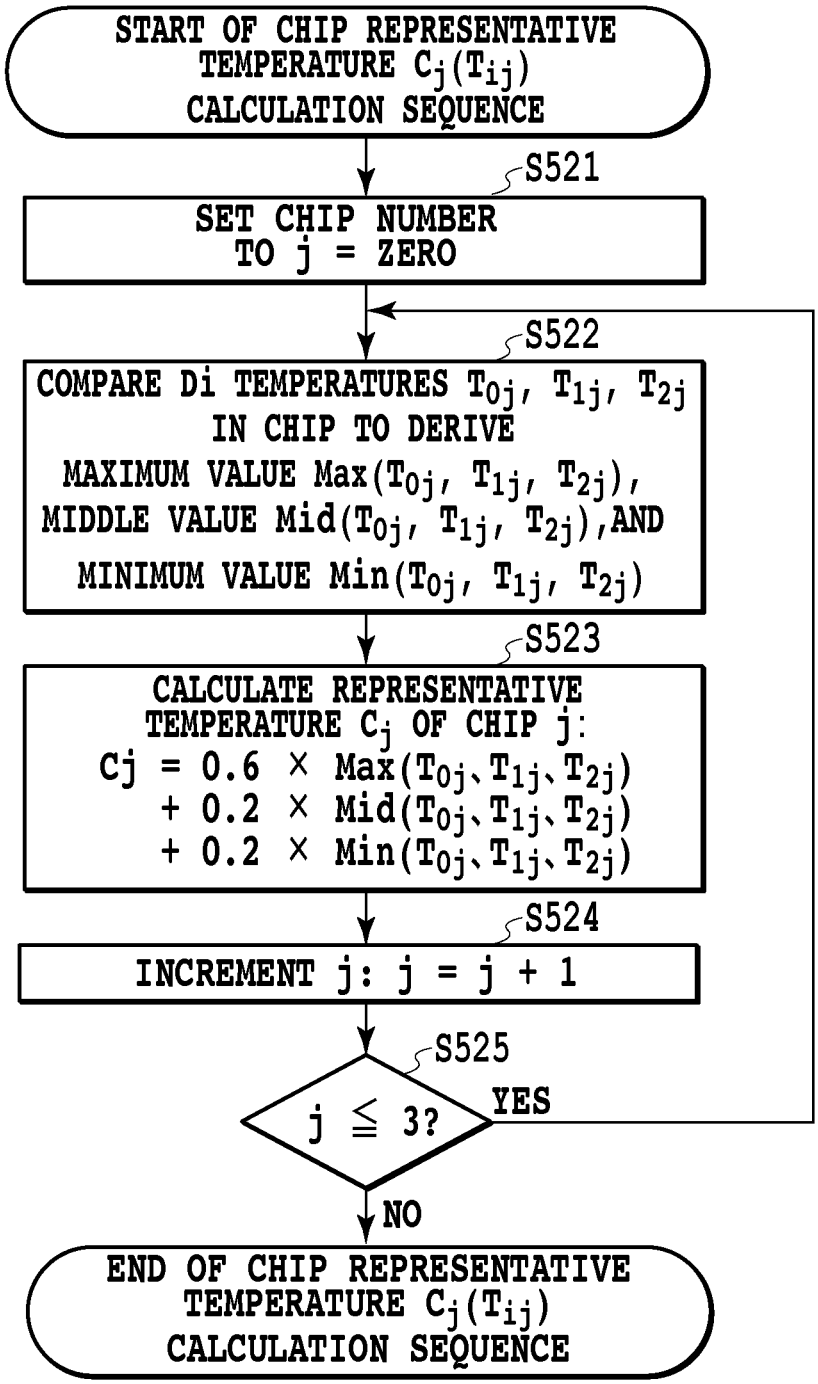

FIGS. 5A to 5C are flow charts explaining a calculation method of a representative temperature Cj (Tij) in the present invention in comparison with the conventional method. Here, FIG. 5A is a flow chart showing the process for finding the representative temperature Cj using a fixed weighted average method in regard to each of chips CP0 to CP3. In the fixed weighted average method, the representative temperature is found by "$Cj=0.2\times T0j+0.6\times T1j+0.2\times T2j$". In the fixed weighted average method, a weighting coefficient (0.6) to a detection temperature T1*j* of the Di sensor placed in the center on the chip is the highest, and the weighting coefficient to each of detection temperatures of the Di sensors placed in both ends on the chip is controlled to 0.2. The reason why the weighting coefficient is thus fixed to the position of the Di sensor is that it is estimated that the Di sensor placed in the center on the chip can detect the temperatures of the most print elements in a highly reliable state.

FIG. 5B is a flow chart showing the process for finding the representative temperature Cj using a maximum value control method in regard to each of chips CP0 to CP3. In the maximum value control method, the maximum value of detection values in the three Di sensors is determined as the representative temperature Cj. That is, the representative temperature Cj can be expressed as "Cj=Max (T0*j*, T1*j*, T2*j*)". The reason why the maximum value of the detection values is thus determined as the representative temperature Cj is that it is estimated that the print element near the Di sensor having detected the maximum value is mostly used in printing and the PWM control is mostly required to the print element in that region.

FIG. 5C is a flow chart showing the process for finding the representative temperature Cj using a dynamic weighted average method characteristic in the present embodiment. In the dynamic weighted average method, a magnitude relation among detection values in the three Di sensors is found and weighting coefficients are set in correspondence to the result. Specifically the maximum value MAX (T0*j*, T1*j*, T2*j*), the middle value Mid (T0*j*, T1*j*, T2*j*), and the minimum value Min (T0*j*, T1*j*, T2*j*) of detection values in the three Di sensors respectively are first found. The representative temperature Cj is calculated by Cj=0.6×Max+0.2×Mid+0.2×Min using these values. In this manner, in the dynamic weighted average method, the weighting coefficient is not fixed to the position of the Di sensor, but the weighting coefficient is allotted based upon the magnitude relation of the detection value. Therefore the weighting coefficient to the detection value of the Di sensor in a region where the use frequency of the print element is high is set high, while the detection value in another region is also used for determining the representative temperature.

It should be noted that in a case where two out of the three detection temperatures correspond to the maximum value, the representative temperature Cj may be calculated by Cj=0.6×Max+0.2×Max+0.2×Min by taking Mid=Max. In addition, in a case where two out of the three detection temperatures correspond to the minimum value, the representative temperature Cj may be calculated by Cj=0.6×Max+0.2×Min+0.2×Min by taking Mid=Min.

Hereinafter, by referring to FIGS. 6A to 10, the effect according to the present embodiment adopting the dynamic weighted average method will be explained in comparison with a case of finding a representative temperature Cj using another method.

Figure 6A:
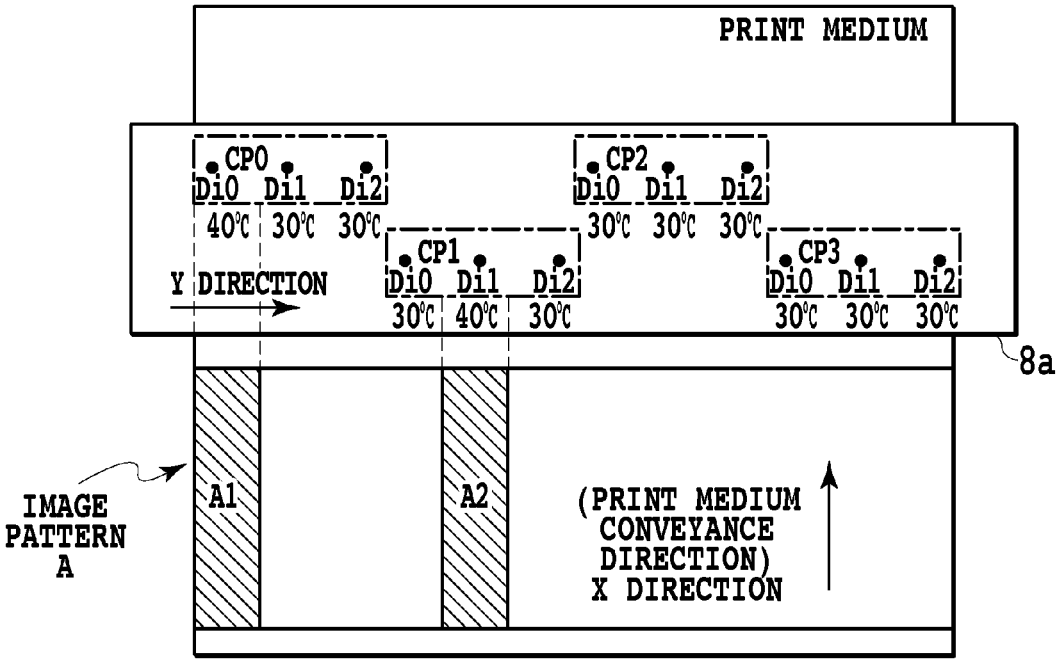
FIGS. 6A and 6B are diagrams each showing an example of a cyan head and an image pattern.
Figure 6B:
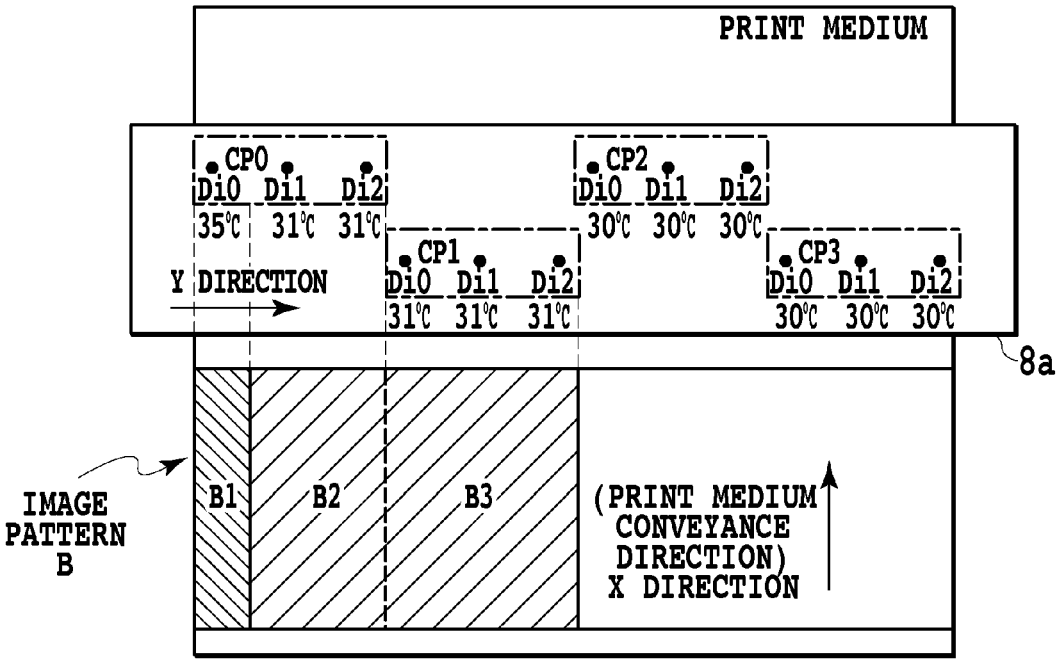

FIGS. 6A and 6B are diagrams each showing an example of the cyan head 8*a* and an image pattern printed thereby. An image pattern A printed in FIG. 6A is a pattern configured by two bands A1 and A2 printed with the same print concentration. The band A1 is printed by print elements near Di0 of CP0, and the band A2 is printed with the print concentration equal to that of the band A1 by print elements near Di1 of CP1.

Here, the print concentration indicates the number of dots printed per unit area of the print medium, and the print elements performing printing with the same print concentration increase substantially equally in temperature. In the present example, a temperature of the print element is 30° C. in a non-printing state, and a temperature of the print element used for printing the image pattern A will increase to 40° C.

On the other hand, an image pattern B printed in FIG. 6B is a pattern configured by a band B1 printed with the relatively high print concentration, and bands B2 and B3 printed with the same print concentration lower than that of the band B1. Here, the band B1 is printed by print elements near Di0 of CP0, and the band B2 is printed by print elements near Di1 and Di2 of CP1, and the band B3 is printed by all the print elements of CP1. Herein the pattern is explained by dividing the band into the three bands, but these bands are continued to constitute a single large band. In the present example also, a temperature of the print element is 30° C. in a non-printing state, and a temperature of the print element used for printing the band B1 will increase to 35° C., and a temperature of the print element used for printing each of the bands B2 and B3 will increase to 31° C.

Figure 7A:
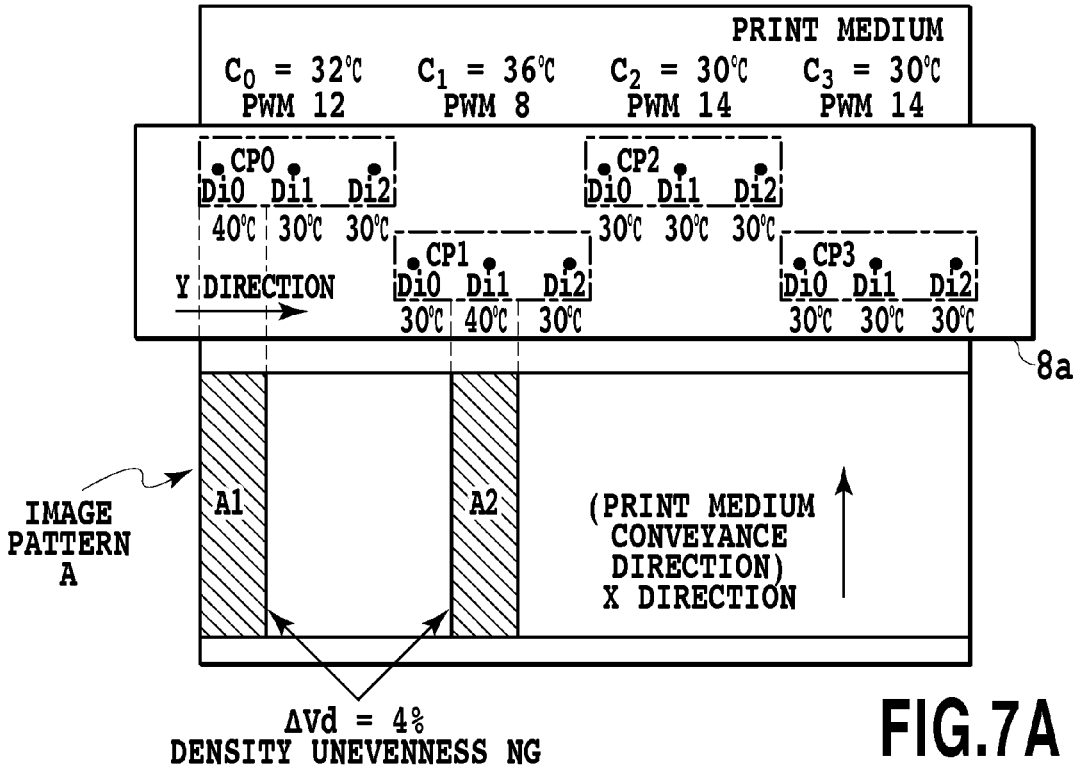
FIGS. 7A and 7B are print state diagrams each showing the PWM control using a fixed weighted average method.
Figure 7B:
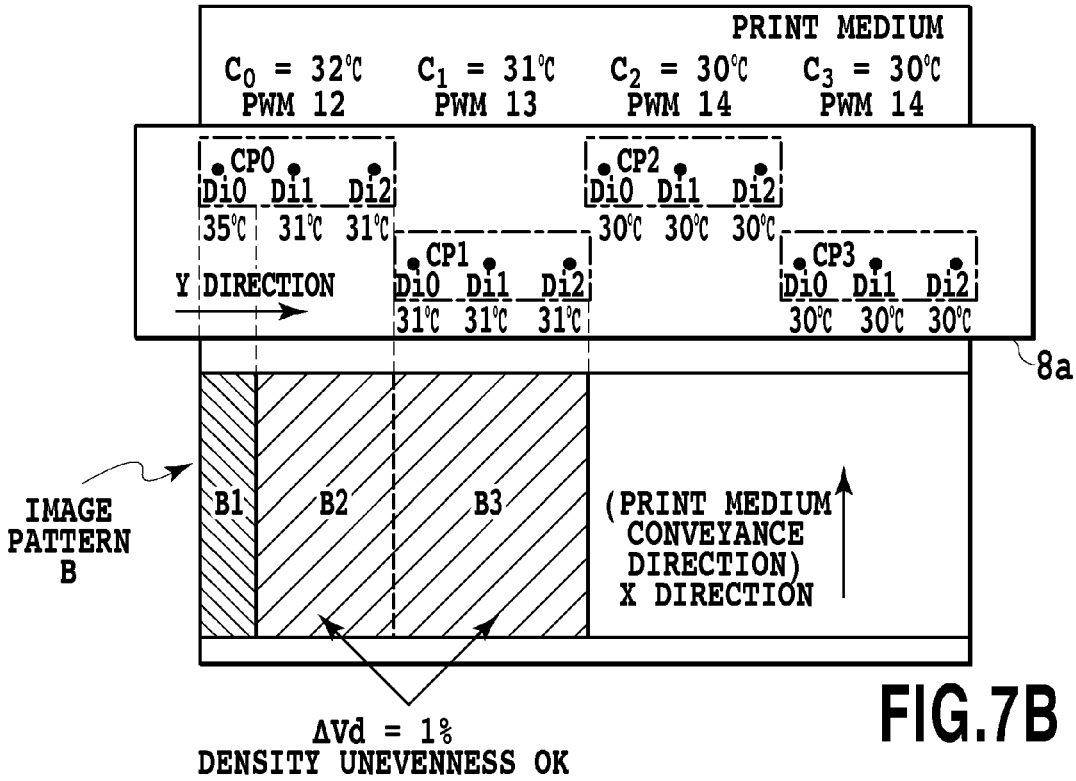

FIGS. 7A and 7B are diagrams each showing a print state in a case of performing the PWM control based upon the representative temperature found by the fixed weighted average method. FIG. 7A shows a state where a pattern A is printed, and thereafter the PWM control is performed thereto, to again print the pattern A. A temperature of the print element not used for printing is 30° C. and a temperature of the print element used for printing will increase to 40° C. Therefore according to the fixed weighted average method, the chip representative temperatures of CP0 and CP1 are as follows.

$$C0=0.2\times40+0.6\times30+0.2\times30=32[^\circ\text{ C.}]$$

$$C1=0.2\times30+0.6\times40+0.2\times30=36[^\circ\text{ C.}]$$

Here, in chip CP0 and CP1, since the similar images (band A1 and band A2) are printed using the print elements of the same numbers, it is estimated that the temperature near the used print element in chip CP0 is actually substantially equal to that of chip CP1. Using the fixed weighted average method, however, the deviation corresponding to 4 (=36−32)° C. occurs between the representative temperatures C0 and C1 as described above. In this situation, by referring to the PWM table shown in FIG. 3C based upon the respective representative temperatures, the drive pulse of the PWM number 12 is set to CP0 and the drive pulse of the PWM number 8 is set to CP1. As a result, the ejection amount of chip CP0 in which the PWM control is performed based upon the lower representative temperature is larger than the ejection amount of chip CP1 in which the PWM control is performed based upon the higher representative temperature.

Here, in the print head according to the present embodiment, when it is assumed that the ejection amount increases by one percent as the temperature near the print element increases by 1° C., the PWM table shown in FIG. 3 is set as a pulse table in which the ejection amount decreases by about one percent each time the representative temperature rises by 1° C. As a result, the ejection amount of CP0 is larger by the order of 4% than the ejection amount of CP1, and also in the outputted image pattern, the density of the band A1 is higher than that of the band A2. In general, when a difference in ejection amount of 3% or more exists, since the density difference can be visually recognized, the density unevenness can be confirmed in this image pattern A. When the image pattern using a part of the print elements in the chip is thus printed using the fixed weighted average method, since the drive pulse set in the individual chip differs depending on a position of the print element used for printing in the chip, the density unevenness tends to be easily confirmed between the chips.

On the other hand, FIG. 7B shows a state where a pattern B is printed, and thereafter the PWM control is performed thereto by the fixed weighted average method, to again print the pattern B. A temperature of the print element used for the printing of the band B1 will increase to 35° C., and the temperature of the print element used for the printing of each of the band B2 and the band B3 will increase to 31° C.

Therefore according to the fixed weighted average method, the chip representative temperatures of CP0 and CP1 are as follows.

$$C0=0.2\times35+0.6\times31+0.2\times31=32[^\circ\ C.]$$

$$C1=0.2\times31+0.6\times31+0.2\times31=31[^\circ\ C.]$$

In this situation, by referring to the PWM table shown in FIG. 3C based upon the respective representative temperatures, the drive pulse of the PWM number 12 is set to CP0 and the drive pulse of the PWM number 13 is set to CP1. In this case, the ejection amount of CP1 is larger by the order of 1% than that of CP0, but since a difference in ejection amount therebetween is not 3% or more, the density unevenness is hard to be confirmed between the band B2 and the band B3.

Figure 8A:
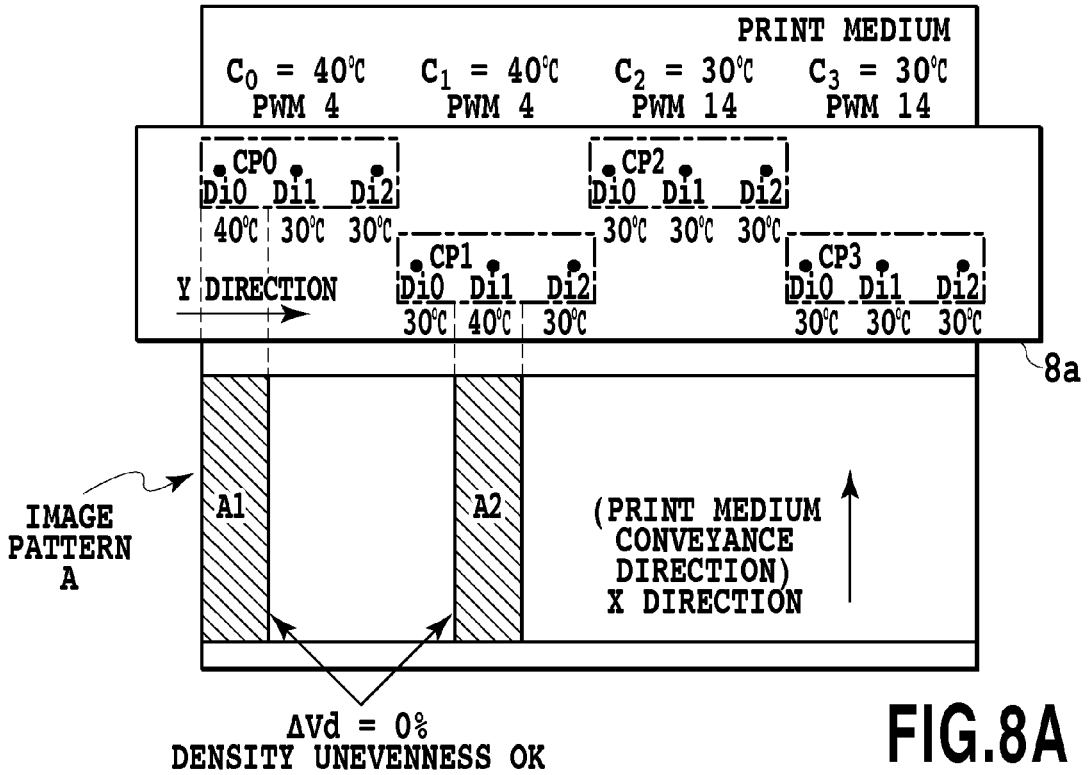
FIGS. 8A and 8B are print state diagrams each showing the PWM control using a maximum value control method.
Figure 8B:
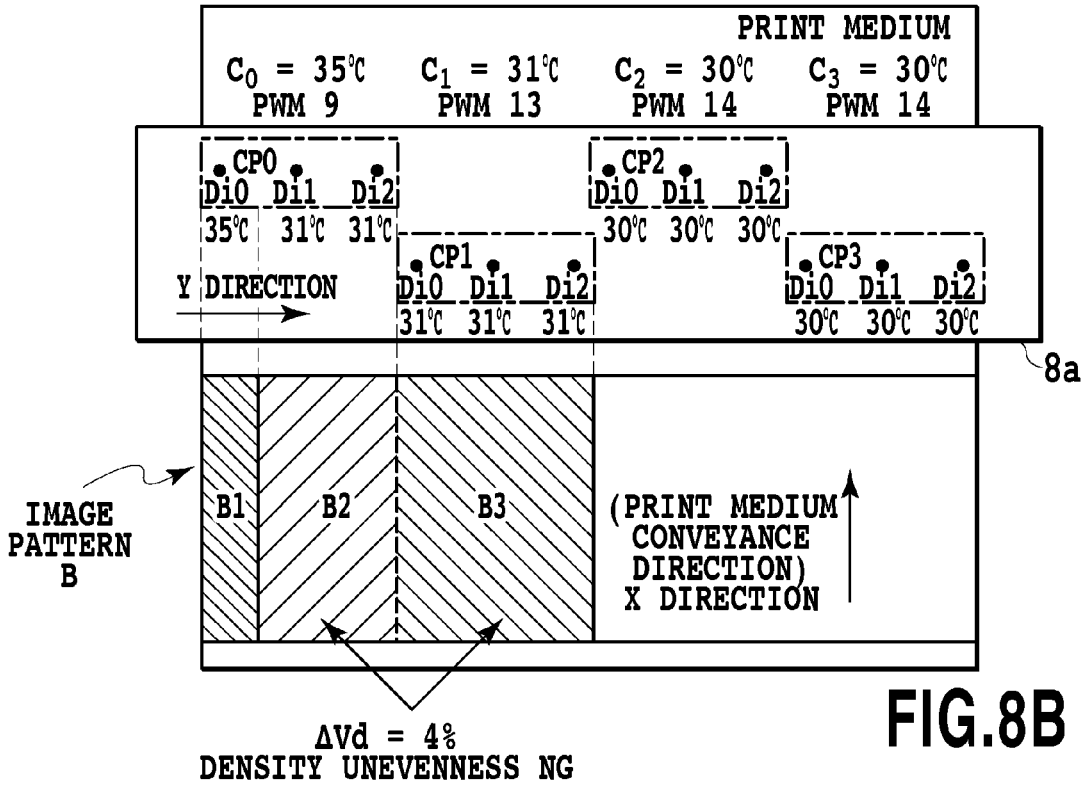

FIGS. 8A and 8B are diagrams each showing a print state in a case of performing the PWM control based upon the representative temperature found by the maximum value control method. FIG. 8A shows a state where a pattern A is printed, and thereafter the PWM control is performed thereto, to again print the pattern A. A temperature of the print element not used for printing will increase to 30° C. and a temperature of the print element used for printing will increase to 40° C. Therefore according to the maximum value control method, the chip representative temperatures of CP0 and CP1 are as follows.

$$C0=\mathrm{MAX}(40,30,30)=40[^\circ\ C.]$$

$$C1=\mathrm{MAX}(30,40,30)=40[^\circ\ C.]$$

In this situation, by referring to the PWM table shown in FIG. 3C based upon the respective representative temperatures, the drive pulse of the PWM number 4 is set to CP0 and CP1. As a result, also in the outputted image pattern, the density of the band A1 becomes equal to that of the band A2, and the density unevenness can not be confirmed.

On the other hand, FIG. 8B shows a state where a pattern B is printed, and thereafter the PWM control is performed thereto by the maximum value control method, to again print the pattern B. A temperature of the print element used for the printing of the band B1 will increase to 35° C., and a temperature of the print element used for the printing of each of the band B2 and the band B3 will increase to 31° C. Therefore according to the maximum value control method, the chip representative temperatures of CP0 and CP1 are as follows.

$$C0=\mathrm{MAX}(35,31,31)=35[^\circ\ C.]$$

$$C1=\mathrm{MAX}(31,31,31)=31[^\circ\ C.]$$

In this situation, by referring to the PWM table shown in FIG. 3C based upon the respective representative temperatures, the drive pulse of the PWM number 9 is set to CP0, and the drive pulse of the PWM number 13 is set to CP1. In this case, the ejection amount of CP1 is larger by the order of 4% than that of CP0, and the density unevenness is confirmed between the band B2 and the band B3.

When the image pattern, in which a difference in print concentration in the chip, that is, a difference in ejection frequency is large, is printed using the maximum value control method, the temperature in a region low in print concentration is not reflected in the PWM control. Therefore in a case where the region where the print concentration is low is continued over plural chips, the density unevenness tends to be easily confirmed therebetween.

Figure 9A:
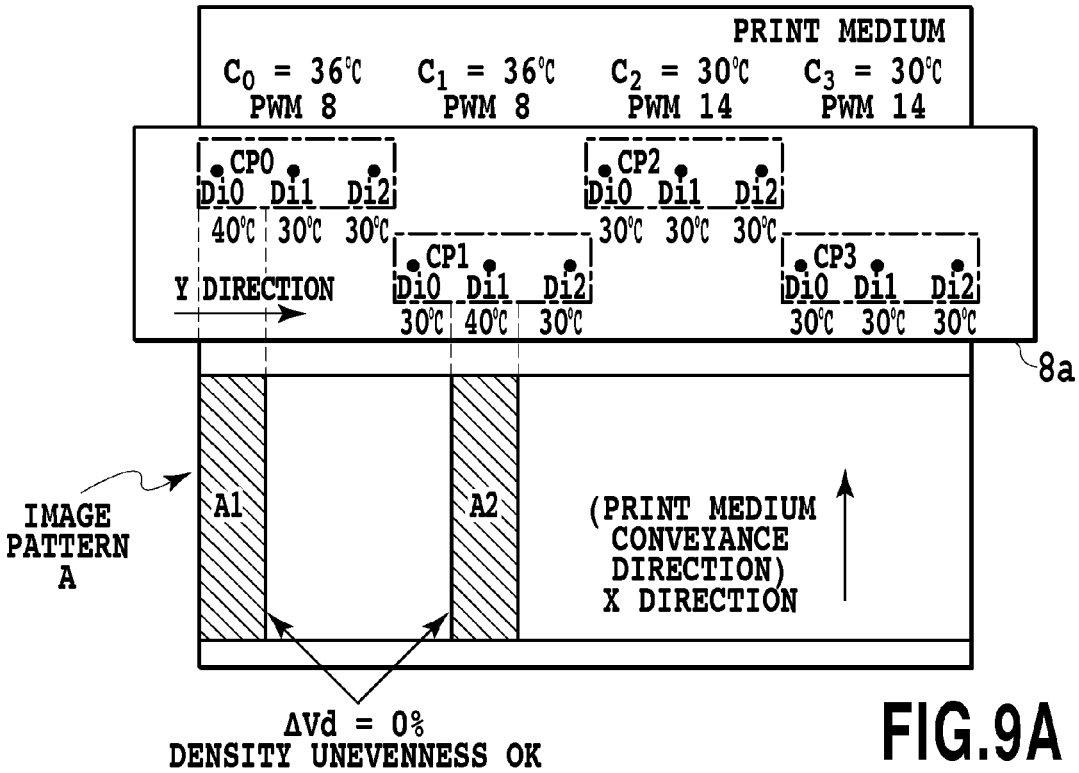
FIGS. 9A and 9B are print state diagrams each showing the PWM control using a dynamic weighted average method.
Figure 9B:
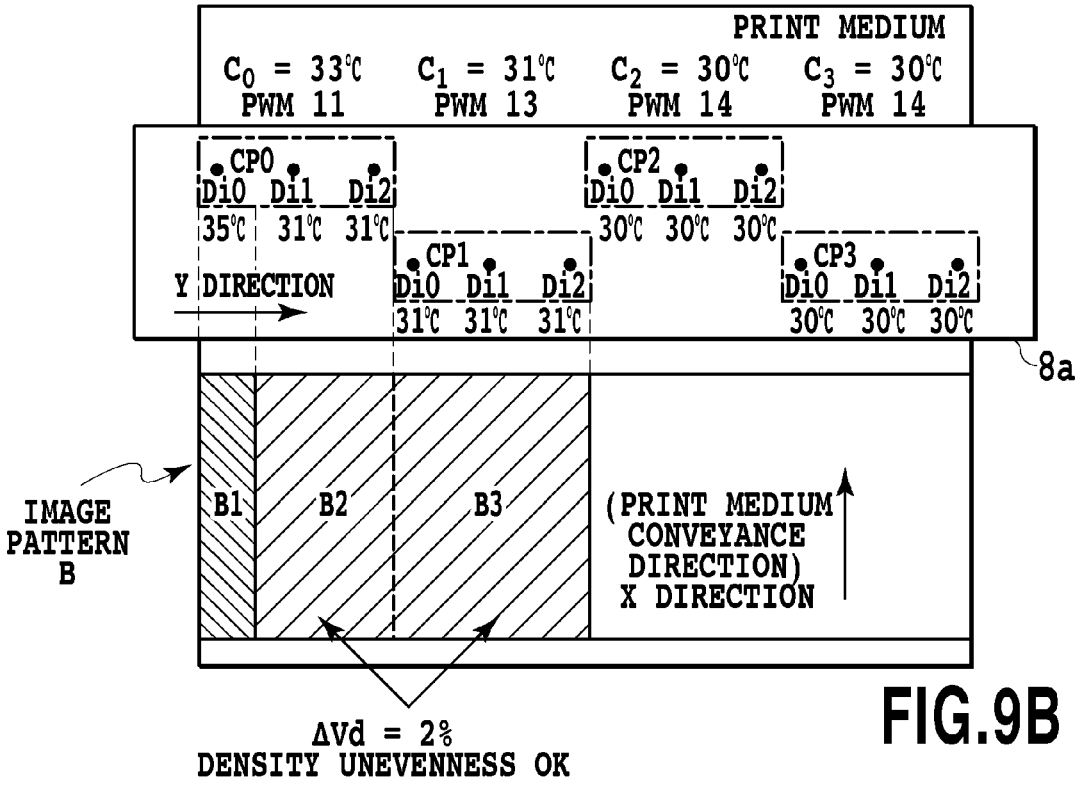

FIGS. 9A and 9B are diagrams each showing a print state in a case of performing the PWM control based upon the representative temperature found by the dynamic weighted average method characteristic in the present embodiment. FIG. 9A shows a state where a pattern A is printed, and thereafter the PWM control is performed thereto, to again print the pattern A. A temperature of the print element not used for printing will increase to 30° C., and a temperature of the print element used for printing will increase to 40° C. Therefore according to the dynamic weighted average method, the chip representative temperatures of CP0 and CP1 are as follows.

$$C0=0.6\times40+0.2\times30+0.2\times30=36[^\circ\ C.]$$

$$C1=0.6\times40+0.2\times30+0.2\times30=36[^\circ\ C.]$$

In this situation, by referring to the PWM table shown in FIG. 3C based upon the respective representative temperatures, the drive pulse of the PWM number 8 is set to CP0 and CP1. As a result, also in the outputted image pattern, the density of the band A1 becomes equal to that of the band A2, and the density unevenness can not be confirmed.

On the other hand, FIG. 9B shows a state where a pattern B is printed, and thereafter the PWM control is performed thereto by the dynamic weighted average method, to again print the pattern B. A temperature of the print element used for the printing of the band B1 will increase to 35° C., and a temperature of the print element used for the printing of each of the band B2 and the band B3 will increase to 31° C. Therefore according to the dynamic weighted average method, the chip representative temperatures of CP0 and CP1 are as follows.

$$C0=0.6\times35+0.2\times31+0.2\times31=33[^\circ\ C.]$$

$$C1=0.6\times31+0.2\times31+0.2\times31=31[^\circ\ C.]$$

In this situation, by referring to the PWM table shown in FIG. 3C based upon the respective representative temperatures, the drive pulse of the PWM number 11 is set to CP0, and the drive pulse of the PWM number 13 is set to CP1. In this case, the ejection amount of CP1 is larger by the order of 2% than that of CP0, but since a difference in ejection amount therebetween is not 3% or more, the density unevenness is hard to be confirmed between the band B2 and the band B3.

In this manner, since the weighting coefficient can be allotted corresponding to the ejection frequency by adopting the dynamic weighted average method, it is avoidable that a different drive pulse is set depending on the position of the print element to be used as in the case of the fixed weighted average method. As a result, the density unevenness as generated in FIG. 7A is not generated in FIG. 9A.

In addition, when the dynamic weighted average method is adopted, the drive pulse is set also in consideration of the temperature in a region where the ejection frequency is low. Therefore even if the continued region low in print concentration exists over the plural chips, it can be suppressed to set the drive pulses extremely different between the adjacent chips as in the case of the maximum value control method. As a result, the density unevenness as generated in FIG. 8B is hard to be confirmed in FIG. 9B.

FIG. 10 is a table summarizing the results explained with reference to FIG. 7A to FIG. 9B. It is found that the density unevenness occurring in the fixed weighted average method or the maximum value control method is not invited in the dynamic weighted average method.

In this manner, according to the present embodiment, the weighting coefficient is allotted corresponding to the ejection frequency, while the representative temperature for performing the PWM control is determined using also the detection temperature in the region low in ejection frequency. Therefore even if temperature variations exist in the print elements on the chip, it is possible to appropriately control the temperature of the entire chip to stably output the image without density unevenness.

Second Embodiment

Figure 11A:
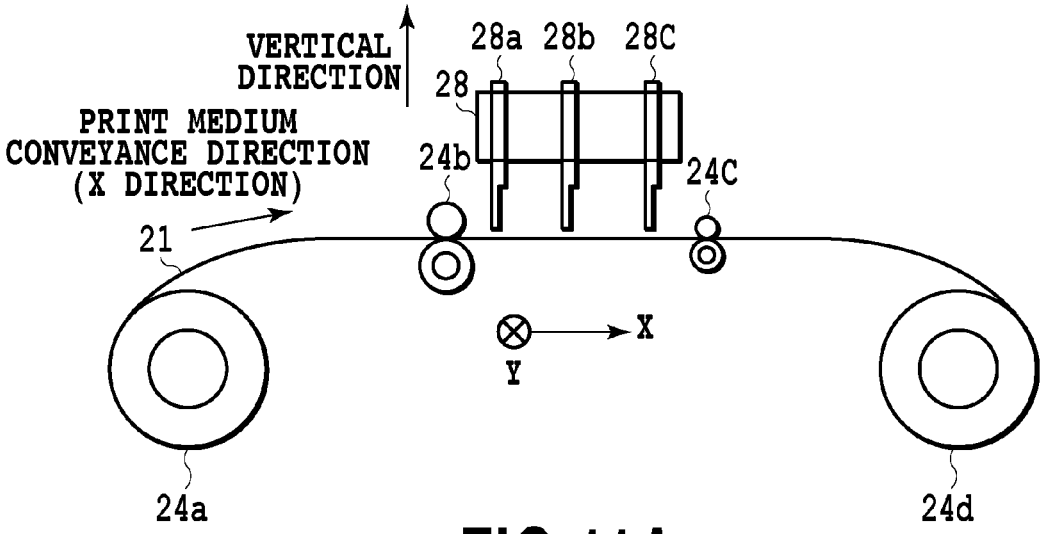
FIGS. 11A and 11B are diagrams showing a printing component and the control configuration according to a second embodiment.
Figure 11B:
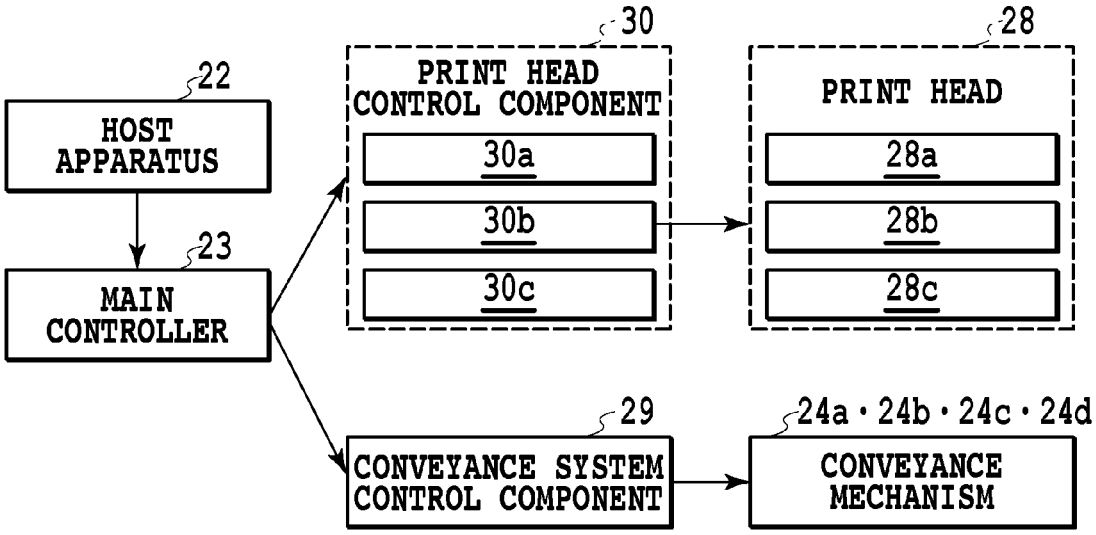

FIGS. 11A and 11B are diagrams respectively explaining the configuration of a printing component and the control configuration in an inkjet printing apparatus according to the present embodiment. Here, only points different from the inkjet printing apparatus according to the first embodiment explained with reference to FIGS. 1A and 1B will be explained.

By referring to FIG. 11A, in the inkjet printing apparatus according to the present embodiment, a print medium 21 wound around a roll paper cassette 24*a* is conveyed in an X direction at a constant conveyance speed with rotation of the roll paper cassette 24*a*. Printing is performed by print heads 28 in a region of the print medium 21 smoothly held by paired upstream conveyance rollers 24*b* and paired downstream conveyance rollers 24*c*. The inkjet printing apparatus according to the present embodiment is not provided with the mechanism such as the scanner or the cutter. The print medium 21 on which the printing is performed is wound around a discharge cassette 24*d* without being cut for accommodation.

By referring to FIG. 11B, a conveyance control component 29 performs rotational drive of the roll paper cassette 24*a*, the paired upstream conveyance rollers 24*b*, the paired downstream conveyance rollers 24*c*, and the discharge cassette 24*d*, subjected to the control of a main controller 23.

FIG. 12A to FIG. 12C are diagrams respectively showing a cyan head 28*a*, an arrangement state of ejection openings in a chip 34*a*, and the control configuration in a print head drive component 30*a*. Here, the cyan head 28*a* will be explained as an example, but a magenta head 28*b* and a yellow head 28*c* each also have the configuration similar to that of the cyan head 28*a*.

In the print head 28*a*, as shown in FIG. 12A in the same way as the first embodiment, four chips of CP0, CP1, CP2, and CP3 are arranged sequentially in the Y direction to be alternately shifted in the X direction. Also in regard to the individual chip, as shown in FIG. 12B, four print element arrays (A array to D array) are formed in parallel. The numbers and the arrangement pitch of the print elements in the print element array, and further the arrangement of Di sensors are also similar to those in the first embodiment.

A point of the present embodiment different from the first embodiment is that sub heaters 38 (38*a*, 38*b*, 38*c* and 38*d*) are arranged to surround the respective print element arrays of A array, B array, C array and D array. These sub heaters 38*a* to 38*d* are used for adjusting the temperature in the chip to a constant temperature.

By referring to FIG. 12C, in the drive component 30*a*, binary image data input to a head driver is converted into drive signals to individual print elements by a heater drive signal generating unit, which are allotted to chip CP0 to chip CP3. Since wiring to the respective print elements is formed in common in the chip, the print elements in the chip are driven by drive pulses each having the same form. In addition, the head driver drives the sub heaters 38*a*, 38*b*, 38*c*, and 38*d* allotted to the individual chips by controlling a sub heater drive signal generating unit. The sub heaters 38*a*, 38*b*, 38*c*, and 38*d* are also wired commonly and driven by a common voltage and a common pulse width.

On the other hand, analogue signals from a plurality of Di sensors are sequentially obtained in response to the switching of a multiplexer, amplified by an amplifier, and then converted into digital signals by an A/D converter. The digital signal is input to the head driver as temperature information. The head driver uses the sub heater drive generating unit to drive the sub heaters 38*a* to 38*d* on the chip, based upon the obtained temperature information (sub heater control) and adjust each chip to a target temperature. This target temperature is a temperature for ensuring stable ejection, and is set to 50° C. in the present embodiment.

Figures 13A, 13B:
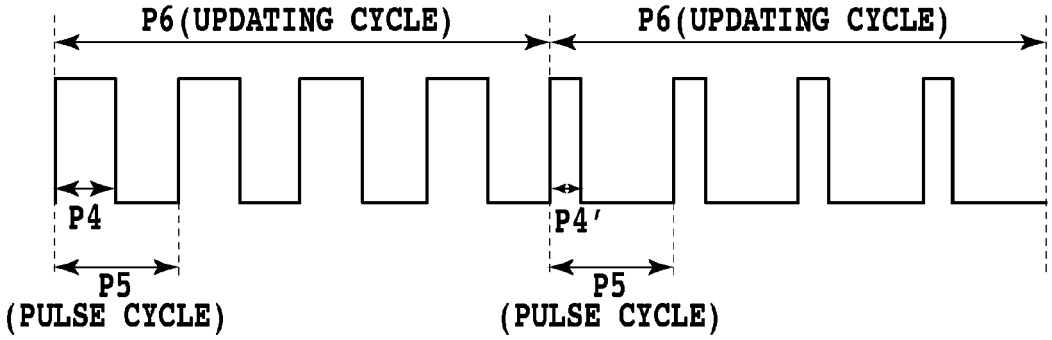
FIGS. 13A and 13B are diagrams explaining sub heater control according to the second embodiment.

FIGS. 13A and 13B are diagrams explaining the sub heater control in the present embodiment. FIG. 13A shows pulse forms at the time of driving the sub heaters 38*a* to 38*d*, and FIG. 13B shows a pulse table to be referred to at the time of setting the pulses as shown in FIG. 13A.

In FIG. 13A, a lateral axis shows time and a vertical axis shows voltages applied to the sub heaters 38*a* to 38*d*. In the present embodiment, a predetermined pulse voltage is repeatedly applied in a cycle of P5, but the pulse width P4 is updated in a cycle of P6. The figure shows a state where the pulse width is switched from P4 to P4' smaller than P4. Since the pulse cycle P5 and the updating cycle P6 are constant, as the pulse width P4 is larger, the energy provided to the sub heaters 38*a* to 38*d* per unit time is the larger, and a temperature of the chip rises. In the present embodiment, the temperature of the chip is controlled with this system to control the ejection amount.

FIG. 13B is a table showing the pulse width P4 set in accordance with the detected chip temperature in the present embodiment. In the sub heater control according to the present embodiment, the energy to the extent of reaching 50° C. as the chip temperature is applied to the chip having a temperature which is less than 50° C. of the target temperature. Therefore In the sub heater table shown in FIG. 13B, the pulse width corresponding to the energy necessary for the temperature of the chip to rise to 50° C. is associated with the detection temperature of the chip. As the detection temperature rises, P4 is the smaller, and in a region where the detection temperature is 50° C. or more, P4 becomes zero, that is, the sub heater 38 is not driven. The PWM table in which the detection temperature and the pulse form correspond on a one-to-one basis is in advance stored in a memory in a print head control component 30.

As already explained, the sub heaters 38*a* to 38*d* to the four print element arrays are commonly wired. Therefore even if three Di sensors are arranged in a single chip, the temperature to be referred to in the sub heater control is a single representative temperature, and the sub heater on the one chip is driven by any one of the pulse widths P4 shown in FIG. 13B set by the representative temperature. On the other hand, even in the same print head (28*a*), different chips (34*a*, 34*b*, 34*c* and 34*d*) can be driven by drive pulses having pulse widths different with each other.

Figure 14:
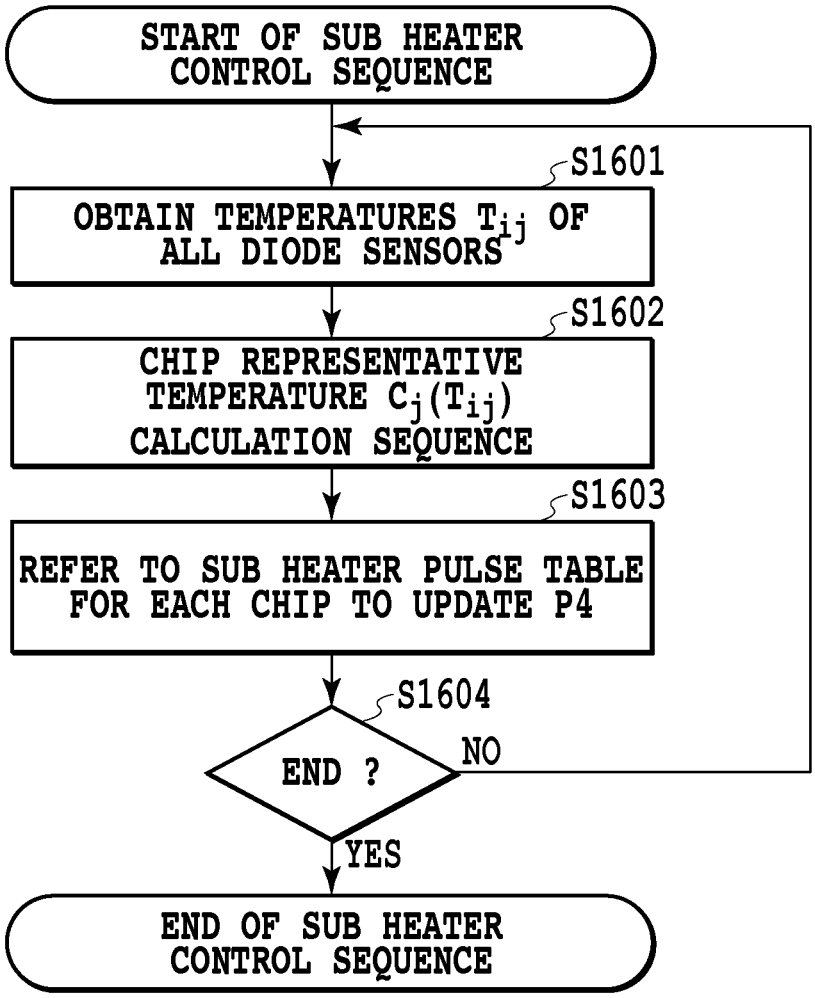
FIG. 14 is a flow chart explaining the process for updating a pulse width P4 to a sub heater of an individual chip.

FIG. 14 is a flow chart explaining the process for updating the pulse width P4 to the sub heaters 38*a* to 38*d* of the individual chip while the head driver performs printing. When the present process starts simultaneously with a start of the printing operation, first at step S1601 the head driver obtains detection temperatures Tij of all the Di sensors on all the chips. Here, an index i is a variable for distinguish the three Di sensors on the same chip, and is an integral number of 0 to 2. In addition, an index j is a variable for distinguish the four chips on the same head, and is an integral number of 0 to 3.

At subsequent step S1602 a representative temperature Cj is calculated for each chip. The representative temperature Cj is expressed as a function of the detection temperatures T0*j*, T1*j* and T2*j* in the three Di sensors and can be expressed by "Cj=Cj (Tij).

At step S1603, by referring to the sub heater table shown in FIG. 13B, the pulse width P4 of the voltage to be applied to the sub heaters 38*a* to 38*d* is updated based upon the representative temperature Cj found at step S1602. At subsequent step S1604, it is determined whether or not printing to the image data input by the job of this time is completed. In a case where it is determined that the image data to be printed is still left, the process goes back to step S1601, and in a case where it is determined that the printing of all the image data is completed, the present process terminates. It should be noted that the process from step S1601 to step S1604 may be repeatedly executed by any interval having time or image data as a unit such that the drive pulse is updated at timing to the extent that the density unevenness is not distinct during the printing operation.

Hereinafter, with reference to FIGS. 15A to 18B, the effect according to the present embodiment in which the dynamic weighted average method is adopted to determine a representative temperature Cj will be explained in comparison with a case of finding a representative temperature Cj using another method.

Figure 15A:
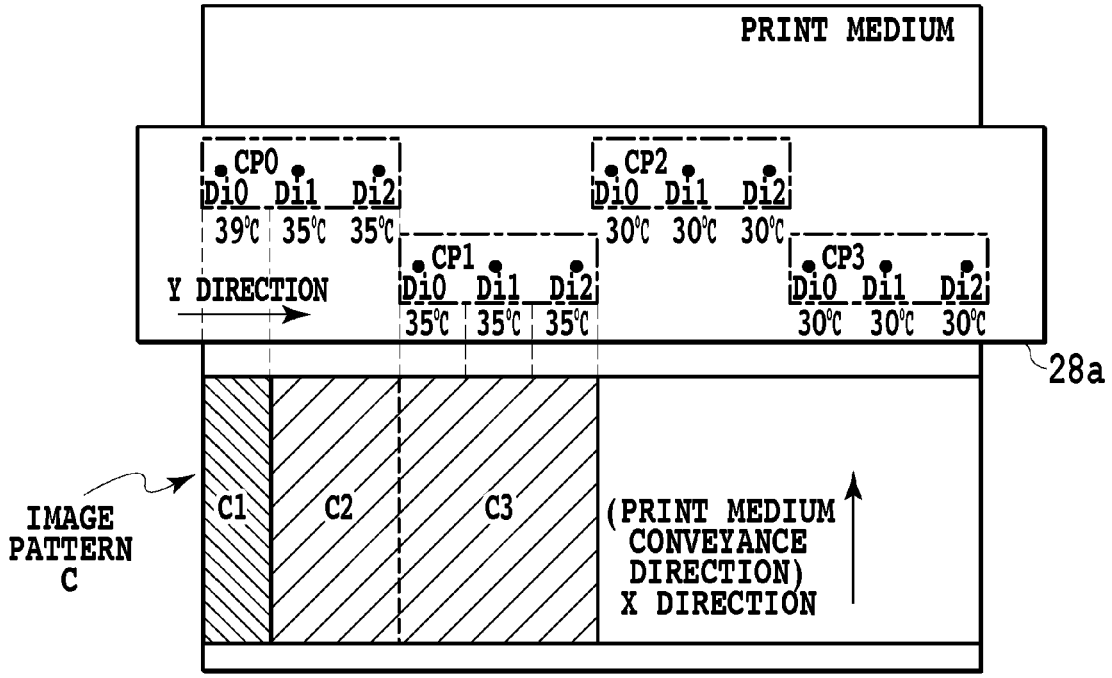
FIGS. 15A and 15B are diagrams each showing an example of a cyan head and an image pattern.
Figure 15B:
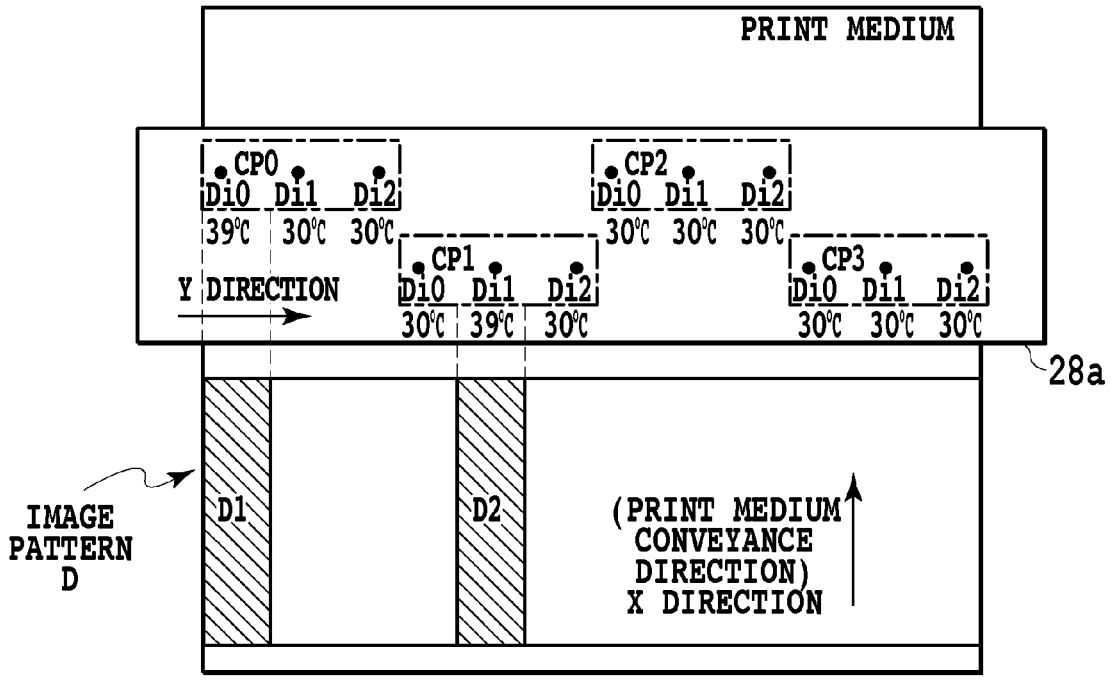

FIGS. 15A and 15B are diagrams each showing an example of the cyan head 28*a* and an image pattern printed thereby. An image pattern C printed in FIG. 15A is a pattern configured by a band C1 printed with the high print concentration, and bands C2 and C3 printed with the same print concentration lower than that of the band B1. Here, the band C1 is printed by print elements near Di0 of CP0, and the band C2 is printed by print elements near Di1 and Di2 of CP0. Further, the band C3 is printed by all the print elements of CP1. Herein for convenience, the pattern is explained by dividing the band into the three bands, but these bands are continued to constitute a single large band. The temperatures shown in the figure show temperatures of print elements in a case where printing is performed without performing the sub heat control. It is estimated that a temperature of the print element used for printing the band C1 will increase to 39° C., and a temperature of the print element used for printing the band C2 and C3 will increase to 35° C.

On the other hand, an image pattern D printed in FIG. 15B is a pattern configured by two bands D1 and D2 printed with the equal print concentration. Here, the band D1 is printed by print elements near Di0 of CP0, and the band D2 is printed by print elements near Di1 of CP1. The temperatures shown in the figure show temperatures of print elements in a case where printing is performed without performing the sub heat control. In the present example, it is estimated that a temperature of the print element not used for printing will increase to 30° C., and a temperature of the print element used for printing the band D1 and D2 will increase to 39° C.

Figure 16A:
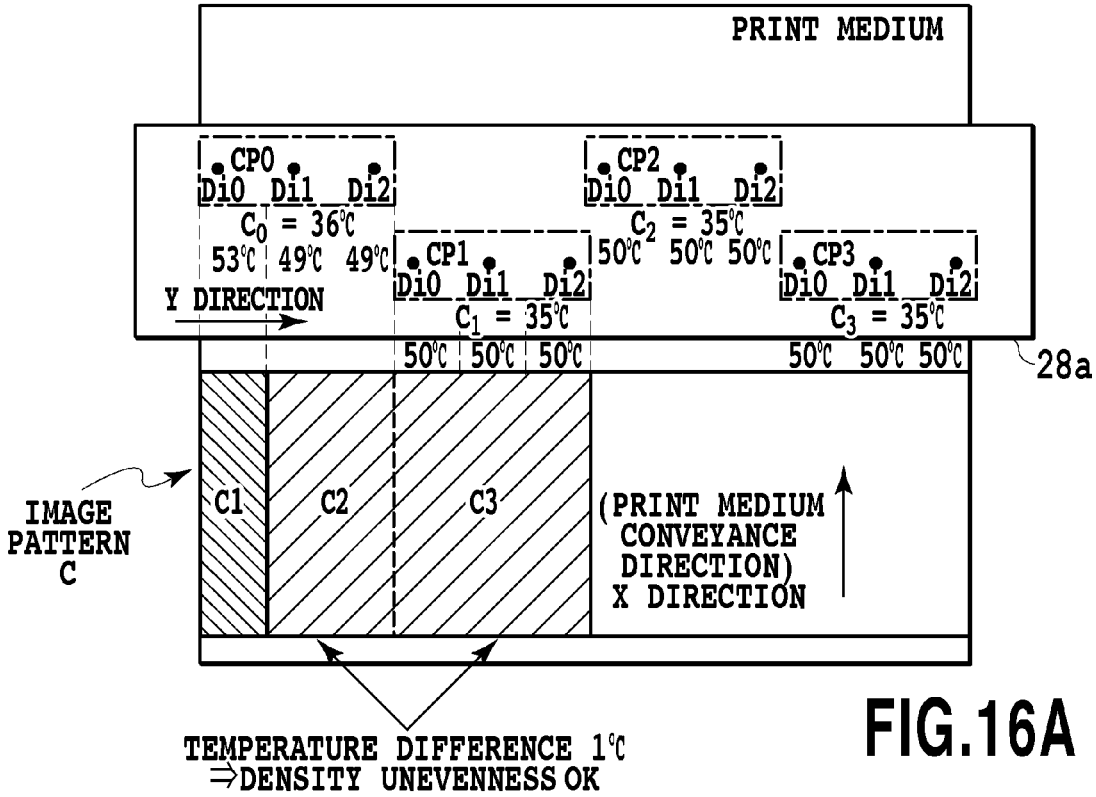
FIGS. 16A and 16B are print state diagrams each showing sub heater control using a fixed weighted average method.
Figure 16B:
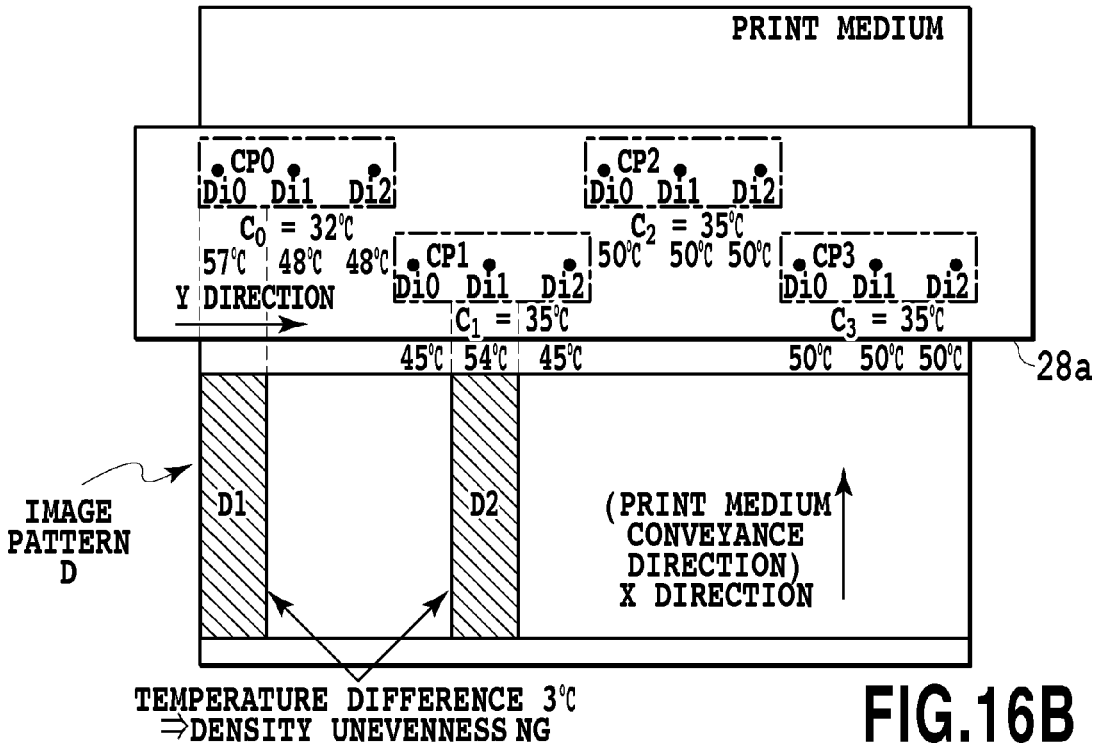

FIGS. 16A and 16B are diagrams each showing a print state in a case of performing the sub heater control based upon the representative temperature found by the fixed weighted average method explained in the first embodiment. FIG. 16A shows a state where a pattern C is printed without performing the sub heater control, and thereafter the sub heater control is performed thereto, to again print the pattern C. A temperature of the print element used for the printing of the band C1 will increase to 39° C., and a temperature of the print element used for the printing of each of the band C2 and the band C3 will increase to 35° C. Therefore according to the fixed weighted average method, the chip representative temperatures of CP0 and CP1 are as follows.

$$C0=0.2\times39+0.6\times35+0.2\times35=36[^\circ\ C.]$$

$$C1=0.2\times35+0.6\times35+0.2\times35=35[^\circ\ C.]$$

In this situation, by referring to the sub heater table shown in FIG. 13B based upon the respective representative temperatures, the pulse width having P4=750 μsec is set to CP0 and the pulse width having P4=800 μsec is set to CP1. In addition, when the sub heaters 38*a* to 38*d* are driven, the energy is applied to CP0 as much as a temperature of CP0 rises by 14° C. (=50° C.−36° C.), and a temperature of Di2 in CP0 reaches 49° C.=35° C.+14° C. In addition, the energy is applied to CP1 as much as a temperature of CP1 rises by 15° C. (=50° C.−35° C.), and a temperature of Di0 in CP1 reaches 50° C.=35° C.+15° C. Thus more energy is provided to chip CP1 in which the sub heater control is performed based upon the lower representative temperature than chip CP0 in which the sub heater control is performed based upon the higher representative temperature, to reach a high temperature. However, also in the present embodiment, when it is assumed that as a temperature near the print element increases by 1° C., the ejection amount increases by 1%, in the same way as the print head in the first embodiment, the ejection amount difference in the boundary between chip CP0 and chip CP1 is 1%, which is not as much as the density unevenness is distinct.

On the other hand, FIG. 16B shows a state where a pattern D is printed, and thereafter the sub heater control is performed thereto by the fixed weighted average method, to again print the pattern D. A temperature of the print element used for the printing of each of the band D1 and the band D2 will increase to 39° C., and a temperature of the print element not used for the printing will increase to 30° C. Therefore according to the fixed weighted average method, the chip representative temperatures of CP0 and CP1 are as follows.

$$C0=0.2\times39+0.6\times30+0.2\times30=32[^\circ\ C.]$$

$$C1=0.2\times30+0.6\times39+0.2\times30=35[^\circ\ C.]$$

In this situation, by referring to the sub heater table shown in FIG. 13B based upon the respective representative temperatures, the pulse width having P4=950 μsec is set to CP0 and the pulse width having P4=800 μsec is set to CP1. In addition, when the sub heaters 38*a* to 38*d* are driven, the energy is applied to CP0 as much as a temperature of CP0 rises by 18° C. (=50° C.−32° C.), and a temperature of Di0 in CP0 reaches 57° C.=39° C.+18° C.). In addition, the energy is applied to CP1 as much as a temperature of CP1 rises by 15° C. (=50° C.−35° C.), and a temperature of Di1 in CP1 reaches 54° C.=39° C.+15° C.). In this case, since a difference in temperature is 3° C. and a difference in ejection amount is the order of 3% between the print element for printing the band D1 and the print element for printing the band D2, the density unevenness is confirmed between the two bands.

Figure 17A:
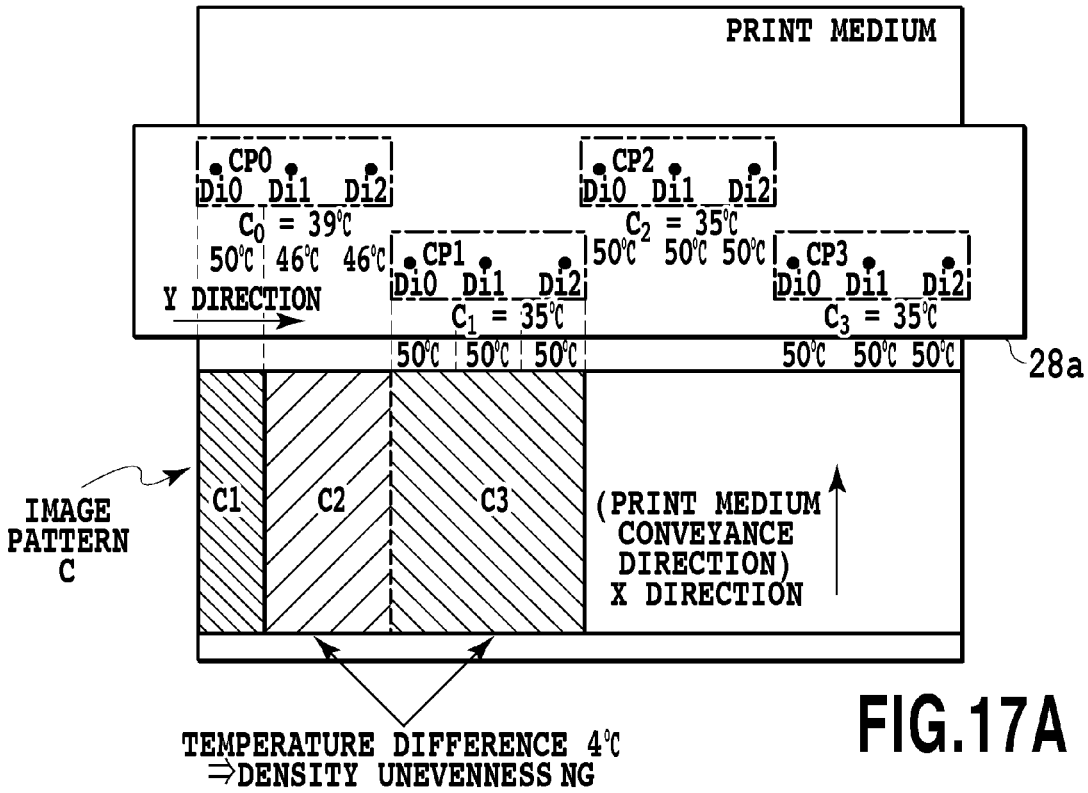
FIGS. 17A and 17B are print state diagrams each showing the sub heater control using a maximum value control method.
Figure 17B:
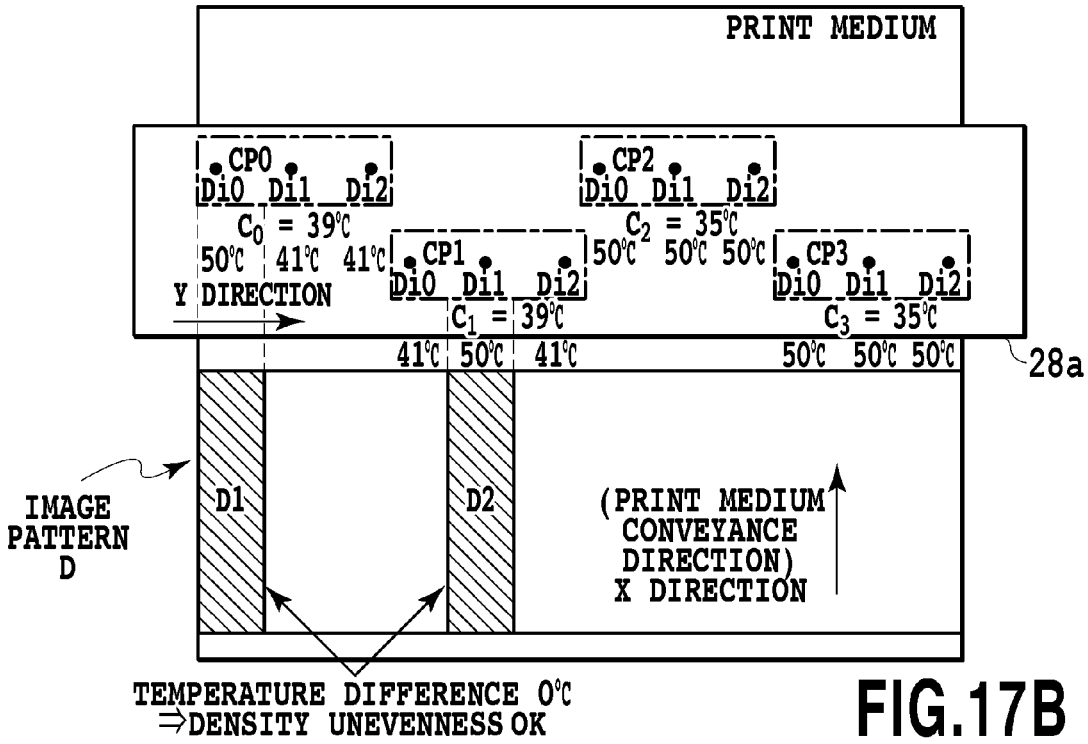

FIGS. 17A and 17B are diagrams each showing a print state in a case of performing the sub heater control based upon the representative temperature found by the maximum value control method explained in the first embodiment. FIG. 17A shows a state where a pattern C is printed without performing the sub heater control, and thereafter the sub heater control is performed thereto, to again print the pattern C. A temperature of the print element used for the printing of the band C1 will increase to 39° C., and a temperature of the print element used for the printing of each of the band C2 and the band C3 will increase to 35° C. Therefore according to the maximum value control method, the chip representative temperatures of CP0 and CP1 are as follows.

$$C0=MAX(39,35,35)=39[^\circ\ C.]$$

$$C1=MAX(35,35,35)=35[^\circ\ C.]$$

In this situation, by referring to the sub heater table shown in FIG. 13B based upon the respective representative temperatures, the pulse width having P4=600 μsec is set to CP0 and the pulse width having P4=800 μsec is set to CP1. In addition, when the sub heaters 38*a* to 38*d* are driven, the energy is applied to CP0 as much as a temperature of CP0 rises by 11° C. (=50° C.−39° C.), and a temperature of Di2 in CP0 reaches 46° C.=35° C.+11° C.). In addition, the energy is applied to CP1 as much as a temperature of CP1 rises by 15° C. (=50° C.−35° C.), and a temperature of Di0 in CP1 reaches 50° C.=35° C.+15° C. In this manner, since a difference in temperature is 4° C. and a difference in ejection amount is 4% between the print element for printing the band C2 and the print element for printing the band C3, the density unevenness is distinct between the two bands.

On the other hand, FIG. 17B shows a state where a pattern D is printed, and thereafter the sub heater control is performed thereto by the maximum value control method, to again print the pattern D. A temperature of the print element used for the printing of each of the band D1 and the band D2 will increase to 39° C., and a temperature of the print element not used for the printing will increase to 30° C. Therefore according to the maximum value control method, the chip representative temperatures of CP0 and CP1 are as follows.

$$C0=\mathrm{MAX}(39,30,30)=39[^\circ\ \mathrm{C.}]$$

$$C1=\mathrm{MAX}(30,39,30)=39[^\circ\ \mathrm{C.}]$$

In this situation, by referring to the sub heater table shown in FIG. 13B based upon the respective representative temperatures, the pulse width having P4=600 μsec is set to CP0 and CP1. In addition, when the sub heaters 38*a* to 38*d* are driven, the energy is applied to CP0 and CP1 as much as a temperature of each of CP0 and CP1 rises by 11° C. (=50° C.−39° C.), and a temperature of Di0 in CP0 and a temperature of Di1 in CP1 reach 50° C.=39° C.+11° C. In this case, since there is no difference in ejection amount between the print element for printing the band D1 and the print element for printing the band D2, the density unevenness is not confirmed between the two bands.

Figure 18A:
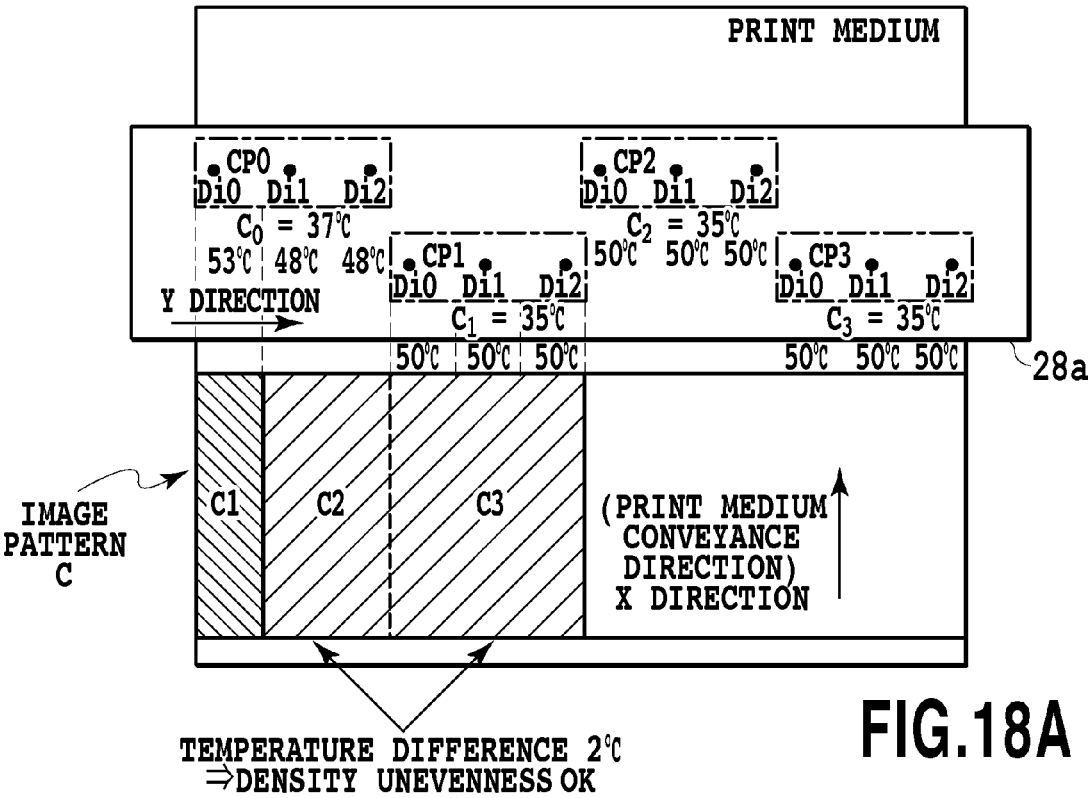
FIGS. 18A and 18B are print state diagrams each showing the sub heater control using a dynamic weighted average method.
Figure 18B:
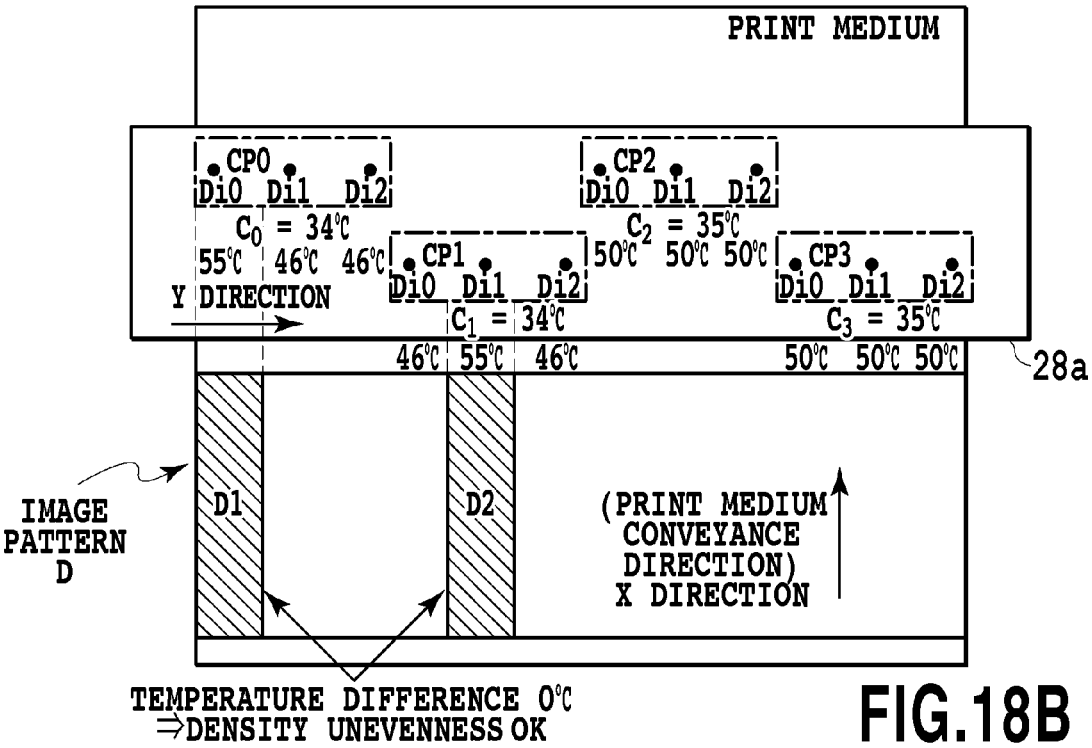

FIGS. 18A and 18B are diagrams each showing a print state in a case of performing the sub heater control based upon the representative temperature found by the dynamic weighted average method in the present embodiment. FIG. 18A shows a state where a pattern C is printed without performing the sub heater control, and thereafter the sub heater control is performed thereto, to again print the pattern C. A temperature of the print element used for the printing of the band C1 will increase to 39° C., and a temperature of the print element used for the printing of each of the band C2 and the band C3 will increase to 35° C. Therefore according to the dynamic weighted average method, the chip representative temperatures of CP0 and CP1 are as follows.

$$C0=0.6\times39+0.2\times35+0.2\times35=37[^\circ\ \mathrm{C.}]$$

$$C1=0.6\times35+0.2\times35+0.2\times35=35[^\circ\ \mathrm{C.}]$$

In this situation, by referring to the sub heater table shown in FIG. 13B based upon the respective representative temperatures, the pulse width having P4=700 μsec is set to CP0 and the pulse width having P4=800 μsec is set to CP1. In addition, when the sub heaters 38*a* to 38*d* are driven, the energy is applied to CP0 as much as a temperature of CP0 rises by 13° C. (=50° C.−37° C.), and a temperature of Di2 in CP0 reaches 48° C.=35° C.+13° C.). In addition, the energy is applied to CP1 as much as a temperature of CP1 rises by 15° C. (=50° C.−35° C.), and a temperature of Di0 in CP1 reaches 50° C.=35° C.+15° C. Thus more energy is provided to chip CP1 in which the sub heater control is performed based upon the lower representative temperature than chip CP0 in which the sub heater control is performed based upon the higher representative temperature. However, since a difference in temperature is 2° C. and a difference in ejection amount is the order of 2% between the print element for printing the band C2 and the print element for printing the band C3, the density unevenness is not confirmed between the two bands.

On the other hand, FIG. 18B shows a state where a pattern D is printed, and thereafter the sub heater control is performed thereto by the dynamic weighted average method, to again print the pattern D. A temperature of the print element used for the printing of each of the band D1 and the band D2 will increase to 39° C., and a temperature of the print element not used for the printing will increase to 30° C. Therefore according to the dynamic weighted average method, the chip representative temperatures of CP0 and CP1 are as follows.

$$C0=0.6\times39+0.2\times30+0.2\times30=35[^\circ\ \mathrm{C.}]$$

$$C1=0.6\times39+0.2\times30+0.2\times30=35[^\circ\ \mathrm{C.}]$$

In this situation, by referring to the sub heater table shown in FIG. 13B based upon the respective representative temperatures, the pulse width having P4=800 μsec is set to CP0 and CP1. In addition, when the sub heaters 38*a* to 38*d* are driven, the energy is applied to CP0 and CP1 as much as a temperature of each of CP0 and CP1 rises by 15° C. (=50° C.−35° C.), and a temperature of Di0 in CP0 and a temperature of Di1 in CP1 reach 54° C.=39° C.+15° C. That is, there is no difference in ejection amount between the print element for printing the band D1 and the print element for printing the band D2, and the density unevenness is not confirmed between the two bands.

In this manner, the weighting coefficient can be allotted corresponding to the detection temperature of the individual Di sensor by adopting the dynamic weighted average method. Therefore it is possible to avoid the situation where the width of the pulse to be applied to the sub heaters 38*a* to 38*d* differs depending on the position of the print element to be used as in the case of the fixed weighted average method. As a result, the density unevenness generated in FIG. 16B is not generated in FIG. 18B.

In addition, when the dynamic weighted average method is adopted, the pulse width is set in consideration of a temperature in a region where the ejection frequency is low and the detection temperature is low. Therefore even if the continued region low in print concentration exists over the plural chips, it can be suppressed to set the pulse widths extremely different between the adjacent chips as in the case of the maximum value control method. As a result, the density unevenness generated in FIG. 17A is not confirmed in FIG. 18A.

FIG. 19 is a table summarizing the results explained with reference to FIG. 16A to FIG. 18B. It is found that the density unevenness appearing in the fixed weighted average method or the maximum value control method is not invited in the dynamic weighted average method.

In this manner, according to the present embodiment, the weighting coefficient is allotted corresponding to the detection temperature, while the detection temperature in the region low in temperature is used, thus determining the representative temperature for performing the sub heater control. Therefore even if temperature variations exist in the print elements on the chip, it is possible to appropriately control the temperature of the entire chip to stably output the image without density unevenness.

In the embodiments as described above, the configuration that the Di sensors are provided at the center and both the sides in the single chip is explained as an example, but the positions and the numbers of the Di sensors on the chip are not limited thereto. In addition, the kind of the temperature sensor is not limited to the Di sensor, and another kind of sensors can be also applied.

In the embodiments as described above, the inkjet print head provided with the four chips is explained as an example, but the present invention is not limited thereto without mentioning. For example, even if the print head is configured by one chip, by adopting the configuration of the present invention, the temperature of the chip can be stabilized to suppress variations in density of the image with an elapse of time.

In addition, in the first and second embodiments aforementioned, the configuration that the wiring to the print elements in the same chip is in common is explained, but the present invention is not limited thereto. Even if the wiring is not in common, the respective print elements in the chip can be driven with the same drive voltage and the same pulse width.

Further, in the first and second embodiments, the weighting coefficients are determined as 0.6, 0.2, and 0.2 in the dynamic weighted average method for obtaining the representative temperature, but the present invention is not limited to these values either without mentioning. The combination of coefficients can be optimized based on the numbers and the arrangement of temperature sensors arranged in the chip or thermal characteristics of the chip.

For example, four kinds of weighting coefficients such as 0.4, 0.3, 0.2 and 0.1 are prepared to four temperatures of T0, T1, T2, and T3 obtained from the four temperature sensors, so that as the detection temperature is higher, the larger weighting coefficient can be associated therewith. As explained specifically in a case where T0>T1>T2>T3, the chip temperature C may be found by $C=0.4\times T0+0.3\times T1+0.2\times T2+0.1\times T3$.

In this manner, in the dynamic weighted average method according to the present invention, the detection temperatures of the temperature sensors arranged on the chip are lined up in high temperature order, and coefficients by which the respective detection temperatures are multiplied are determined to be associated with the above order at that time. Based upon it, the representative temperature may be determined from the weighted average. Based upon the representative temperature thus obtained, the drive pulse in common in the chip may be associated with the individual chip to be set and applied.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Applications No. 2011-224816 filed on Oct. 12, 2011 and No. 2012-161416 filed on Jul. 20, 2012, which are hereby incorporated by reference herein in their entirety.

What is claimed is:

1. An inkjet printing apparatus comprising:

a print head comprising a substrate provided with an element array, in which a plurality of print elements for ejecting ink by applying drive pulses thereto are arranged, and a plurality of temperature sensors for temperature measurement;

an obtaining unit configured to find respective temperatures of the plurality of the temperature sensors to obtain a plurality of detection temperatures;

a determining unit configured to line up the plurality of the detection temperatures in temperature order to determine coefficients by which the respective detection temperatures are multiplied, and which are associated with the temperature order at the lining-up; and a calculating unit configured to multiply each of the plurality of the detection temperatures by the corresponding coefficient determined by the determining unit for a weighted average to calculate a representative temperature.

2. An inkjet printing apparatus according to claim 1, further comprising:

a drive control unit configured to control a drive pulse applied to the plurality of print elements based upon the representative temperature.

3. An inkjet printing apparatus according to claim 2, wherein the drive control unit refers to a table storing relationships between a plurality of reference temperatures and a plurality of drive pulses to determine the drive pulse based upon the representative temperature.

4. An inkjet printing apparatus according to claim 1, wherein the determining unit determines a coefficient corresponding to a maximum detected temperature among the plurality of detection temperatures from the plurality of the temperature sensors is to be larger than a coefficient by which another detection temperature is multiplied.

5. An inkjet printing apparatus according to claim 1, wherein the plurality of the temperature sensors are arranged along a direction in which the plurality of the print elements are arranged.

6. An inkjet printing apparatus according to claim 1, wherein a plurality of the substrates are provided in the print head.

7. An inkjet printing apparatus according to claim 6, wherein the plurality of the substrates are arranged along a direction in which the plurality of the print elements are arranged.

8. An inkjet printing apparatus according to claim 6, wherein the calculating unit determines the representative temperature for each of the plurality of the substrates.

9. An inkjet printing apparatus according to claim 1, wherein the temperature sensor includes a diode sensor.

10. An inkjet printing apparatus according to claim 1, further comprising:

a heating unit configured to heat the substrate; and a heating control unit configured to control an energy amount supplied to the heating unit based upon the representative temperature.

11. An inkjet printing apparatus comprising:

a print head having a substrate provided with an printing element array in which a plurality of print elements, configured to eject ink and driven by drive pulses, are arranged in a predetermined direction, and a plurality of temperature sensors, for measuring temperatures relating the print elements, which are arranged in the predetermined direction;

an obtaining unit configured to obtain information regarding the temperatures measured by the plurality of temperature sensors;

a determining unit configured to determine a plurality of coefficients respectively corresponding to the plurality of temperatures measured by the plurality of temperature sensors and indicated by the information obtained by the obtaining unit, such that a coefficient for the highest temperature among the plurality of temperatures is larger than coefficients for temperatures other than the highest temperature among the plurality of temperatures;

a calculating unit configured to calculate a representative temperature based on the plurality of temperatures indicated by the information obtained by the obtaining unit and the plurality of coefficients respectively correspond to the plurality of temperatures determined by the determining unit; and a controlling unit configured to control ink ejection from the print head based on the representative temperature calculated by the calculating unit.

12. The inkjet printing apparatus according to claim 11, wherein the calculating unit calculates the representative temperature by (i) multiplying the plurality of temperatures by the plurality of coefficients determined by the determining unit, respectively, to obtain a plurality of weighted temperatures corresponding to the plurality of temperature sensors, and (ii) adding the plurality of weighted temperatures to obtain the representative temperature.

13. The inkjet printing apparatus according to claim 11, wherein the controlling unit is further configured to determine a driving pulse for applying to the plurality of printing elements based on the representative temperature calculated by the calculating unit and to control ink ejection by applying the determined driving pulse to the plurality of printing elements.

14. An inkjet printing apparatus according to claim 13, wherein the controlling unit refers to a table storing relationships between a plurality of reference temperatures and a plurality of drive pulses to determine the drive pulse based upon the representative temperature calculated by the calculating unit.

15. The inkjet printing apparatus according to claim 11, wherein the substrate is further provided with a heating element for heating the substrate, and wherein the controlling unit is further configured to determine a driving pulse for applying to the heating element based on the representative temperature calculated by the calculating unit and to control ink ejection by applying the determined driving pulse to the heating element.

16. An inkjet printing apparatus according to claim 11, wherein the determining unit determines the plurality of coefficients such that larger coefficients correspond to higher temperatures.

17. The inkjet printing apparatus according to claim 11, wherein a plurality of the substrates are provided in the print head.

18. The inkjet printing apparatus according to claim 17, wherein the plurality of the substrates are arranged along the predetermined direction.

19. The inkjet printing apparatus according to claim 17, wherein each of the obtaining unit, the determining unit, and the calculating unit performs obtaining, determining, and calculating with respect to each of the plurality of the substrates.

20. The inkjet printing apparatus according to claim 11, wherein the temperature sensor includes a diode sensor.

21. An inkjet printing method for printing image by using a print head having a substrate provided with an printing element array in which a plurality of print elements, configured to eject ink and driven by drive pulses, are arranged in a predetermined direction, and a plurality of temperature sensors, for measuring temperatures relating the print elements, which are arranged in the predetermined direction, the method comprising:

an obtaining step of obtaining information regarding the temperatures measured by the plurality of temperature sensors;

a determining step of determining a plurality of coefficients respectively corresponding to the plurality of temperatures measured by the plurality of temperature sensors and indicated by the information obtained in the obtaining step, such that a coefficient for the highest temperature among the plurality of temperatures is larger than coefficients for temperatures other than the highest temperature among the plurality of temperatures;

a calculating step of calculating a representative temperature based on the plurality of temperatures indicated by the information obtained in the obtaining step and the plurality of coefficients for each of the plurality of temperatures determined in the determining step; and a controlling step of controlling ink ejection from the print head based on the representative temperature calculated in the calculating step.

22. The inkjet printing method according to claim 21, wherein the calculating step calculates the representative temperature by (i) multiplying the plurality of temperatures by the plurality of coefficients determined in the determining step, respectively, to obtain a plurality of weighted temperatures corresponding to the plurality of temperature sensors, and (ii) adding the plurality of weighted temperatures to obtain the representative temperature.

23. The inkjet printing method according to claim 21, wherein a driving pulse to be applied to the plurality of printing elements is determined, in the determining step, based on the representative temperature calculated in the calculating step, and ink is ejected by applying the determined driving pulse to the plurality of printing elements.

24. An inkjet printing method according to claim 23, wherein reference to a table storing relationships between a plurality of reference temperatures and a plurality of drive pulses is made, in the controlling step, to determine the drive pulse based upon the representative temperature calculated by the calculating step.

25. The inkjet printing method according to claim 21, wherein the substrate is further provided with a heating element for heating the substrate, and wherein a driving pulse to be applied to the heating element, is determined in the controlling step, based on the representative temperature calculated by the calculating step, and ink is ejected by applying the determined driving pulse to the heating element.

26. An inkjet printing method according to claim 21, wherein the plurality of coefficients are determined, in the determining step, such that larger coefficients correspond to higher temperatures.

* * * * *